US010799021B2

(12) United States Patent
Choi et al.

(10) Patent No.: US 10,799,021 B2
(45) Date of Patent: Oct. 13, 2020

(54) LAUNDRY TREATMENT APPARATUS AND METHOD OF CONTROLLING THE SAME

(71) Applicant: LG ELECTRONICS INC., Seoul (KR)

(72) Inventors: Changgyu Choi, Seoul (KR); Jongseok Jung, Seoul (KR); Seongmin Jang, Seoul (KR); Junho Lee, Seoul (KR); Jihong Lee, Seoul (KR); Kwanwoong Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 152 days.

(21) Appl. No.: 15/607,848

(22) Filed: May 30, 2017

(65) Prior Publication Data

US 2017/0340106 A1 Nov. 30, 2017

Related U.S. Application Data

(60) Provisional application No. 62/423,201, filed on Nov. 17, 2016.

(30) Foreign Application Priority Data

May 30, 2016 (KR) ..... 10-2016-0066753

(51) Int. Cl.
*A47B 47/03* (2006.01)
*D06F 39/02* (2006.01)
(Continued)

(52) U.S. Cl.
CPC ..... *A47B 47/03* (2013.01); *D06F 39/022* (2013.01); *D06F 39/08* (2013.01); *D06F 39/14* (2013.01);
(Continued)

(58) Field of Classification Search
CPC ... A47B 47/03; A47B 2210/17; D06F 39/022; D06F 39/08; D06F 39/14; D06F 35/00;
(Continued)

(56) References Cited

U.S. PATENT DOCUMENTS

2008/0053162 A1* 3/2008 Park ..... D06F 39/125 68/13 R
2008/0053163 A1* 3/2008 Park ..... D06F 29/00 68/13 R
(Continued)

FOREIGN PATENT DOCUMENTS

CN 2825697 10/2006
CN 201198534 2/2009
(Continued)

OTHER PUBLICATIONS

Extended European Search Report in European Application No. 17173494.0, dated Aug. 10, 2017, 9 pages (with English translation).
Chinese Office Action in Chinese Appln. No. 201710389698.4, dated Jan. 24, 2019, 18 pages (with English translation).

*Primary Examiner* — Benjamin L Osterhout
(74) *Attorney, Agent, or Firm* — Fish & Richardson P.C.

(57) ABSTRACT

A laundry treatment apparatus that includes: a cabinet; a first cabinet door; a second cabinet door; a first washing apparatus; and a second washing apparatus including: a tub that is accessible through a second opening in a state in which the second cabinet door is opened, that is configured to store water, and that includes a tub opening at a top of the tub, a tub cover that is coupled to the tub and that covers the tub opening, and a drum that is configured to rotate about a shaft, the shaft extending in the second direction, wherein the tub cover includes an air channel unit that is configured to transfer air between an interior area of the tub and an
(Continued)

exterior area of the tub in a state in which the second washing apparatus is operational is disclosed.

20 Claims, 16 Drawing Sheets

(51) Int. Cl.

| | |
|---|---|
| ***D06F 39/14*** | (2006.01) |
| ***D06F 39/08*** | (2006.01) |
| ***D06F 35/00*** | (2006.01) |
| ***D06F 39/00*** | (2020.01) |
| *D06F 39/12* | (2006.01) |
| *D06F 29/00* | (2006.01) |
| *D06F 31/00* | (2006.01) |
| *D06F 23/04* | (2006.01) |

(52) U.S. Cl.
CPC ..... *A47B 2210/17* (2013.01); *D06F 23/04* (2013.01); *D06F 29/005* (2013.01); *D06F 31/00* (2013.01); *D06F 35/00* (2013.01); *D06F 39/00* (2013.01); *D06F 39/088* (2013.01); *D06F 39/12* (2013.01); *D06F 39/125* (2013.01)

(58) Field of Classification Search
CPC ..... D06F 39/00; D06F 31/00; D06F 39/088; D06F 39/12; D06F 39/125; D06F 23/04; D06F 29/005
See application file for complete search history.

(56) References Cited

U.S. PATENT DOCUMENTS

| | | | | |
|---|---|---|---|---|
| 2008/0053164 | A1* | 3/2008 | Park | D06F 29/00 68/13 R |
| 2008/0163651 | A1* | 7/2008 | Jeong | D06F 29/00 68/5 C |
| 2011/0265524 | A1* | 11/2011 | Kim | D06F 29/00 68/13 R |
| 2012/0234054 | A1 | 9/2012 | Kim et al. | |
| 2014/0223758 | A1* | 8/2014 | Bison | D06F 58/206 34/86 |
| 2014/0238086 | A1* | 8/2014 | Choi | D06F 58/24 68/20 |
| 2014/0238087 | A1* | 8/2014 | Bae | D06F 31/00 68/27 |
| 2014/0238088 | A1* | 8/2014 | Bae | D06F 31/00 68/27 |
| 2015/0059418 | A1* | 3/2015 | Lee | D06F 37/267 68/17 R |

FOREIGN PATENT DOCUMENTS

| | | |
|---|---|---|
| CN | 202107903 | 1/2012 |
| CN | 202688699 | 1/2013 |
| CN | 105316900 | 2/2016 |
| EP | 1666656 | 6/2006 |
| EP | 2949806 | 12/2015 |
| JP | 2004222758 | 8/2004 |
| JP | 4805896 | 11/2011 |

* cited by examiner (a)

(b)

(a)

(b)

LAUNDRY TREATMENT APPARATUS AND METHOD OF CONTROLLING THE SAME

CROSS-REFERENCE TO RELATED APPLICATIONS

This application claims the benefit of Korean Patent Application No. 10-2016-0066753, filed on May 30, 2016 and U.S. Provisional Patent Application No. 62/423,201, filed on Nov. 17, 2016, the contents of which are incorporated by reference herein in their entireties.

TECHNICAL FIELD

The present application relates to a laundry treatment apparatus and a method of controlling the same.

BACKGROUND

Generally, a laundry treatment apparatus is a concept including an apparatus that is capable of washing laundry (objects to be washed), an apparatus that is capable of drying laundry (objects to be dried), and an apparatus that is capable of washing and drying laundry.

Conventional laundry treatment apparatuses are classified into a front loading type laundry treatment apparatus, into which laundry is introduced through an introduction port provided in the front thereof, and a top loading type laundry treatment apparatus, into which laundry is introduced through an introduction port provided in the top thereof.

The top loading type laundry treatment apparatus includes a tub having an introduction port provided in the top thereof, a drum rotatably provided in the tub, and a door for opening and closing the introduction port.

In general, a single large-capacity laundry treatment apparatus is used in each home. When laundry is to be sorted into respective kinds for washing, therefore, the laundry treatment apparatus must be used several times. For example, when laundry, such as adult clothes, and laundry, such as underwear or baby clothes, are to be separately washed, the laundry treatment apparatus is used to wash the former kind of laundry, and then the laundry treatment apparatus is used to wash the latter kind of laundry. As a result, washing time is increased, and power consumption is also increased.

In addition, using a conventional large-sized laundry treatment apparatus to wash a small amount of laundry is not preferable in terms of energy savings. Since a washing course set in the large-sized laundry treatment apparatus is generally used to wash a large amount of laundry, water consumption is high. Furthermore, power consumption to rotate a large-sized drum or inner tub is also high. In addition, since the washing course is used to wash a large amount of laundry, the washing time is relatively long. Furthermore, since the washing course set in the large-sized laundry treatment apparatus is mainly used for general clothes, the large-sized laundry treatment apparatus may not be suitable for washing delicate clothes, such as underwear or baby clothes.

The large-sized laundry treatment apparatus is also not suitable for frequently washing small amounts of laundry. Consumers tend to gather laundry for several days or more in order to wash laundry at once.

If underwear or baby clothes remain unwashed for a long time, it is not sanitary. If such laundry remains unwashed for a long time, dirt may become more strongly adhered to the laundry, with the result that the laundry may not be thoroughly washed. For the above reasons, a small-sized laundry treatment apparatus having a smaller capacity than the large-sized laundry treatment apparatus is required.

If two small-sized laundry treatment apparatuses are installed side by side in each home, however, it is not preferable in terms of space utilization or the external appearance thereof.

In recent years, there has been proposed a combination-type laundry treatment apparatus including both a front loading type laundry treatment apparatus and a top loading type laundry treatment apparatus in order to solve the above problem.

The top loading type laundry treatment apparatus is provided on or under the front loading type laundry treatment apparatus in order to wash a small amount of laundry, thereby improving space utilization.

The height of the top loading type laundry treatment apparatus, which is an auxiliary laundry treatment apparatus, is limited. If the top loading type laundry treatment apparatus is high, the washing capacity of the apparatus is increased. In this case, however, it may be difficult for a user to access the top loading type laundry treatment apparatus, since the top loading type laundry treatment apparatus is provided on the front loading type laundry treatment apparatus. For this reason, it is preferable to configure the top loading type laundry treatment apparatus such that the top loading type laundry treatment apparatus is lower than conventional top loading type laundry treatment apparatuses.

The laundry treatment apparatus, particularly the top loading type laundry treatment apparatus, which has a relatively small capacity, is characterized in that the distance between the introduction port and the upper end of the drum is very small.

Consequently, washing must be performed in the state in which the laundry treatment apparatus is substantially sealed in order to prevent wash water or bubbles from being discharged to the outside.

In such a small-sized laundry treatment apparatus, however, it is not preferable to completely seal the space for treating laundry. The reasons for this is that wash water is introduced into the space and is discharged from the space and that the pressure in the space may be abruptly changed as a result of change in temperature, resulting in the damage to components in the space.

Consequently, it is difficult to manufacture a small-sized laundry treatment apparatus.

SUMMARY

In general, one innovative aspect of the subject matter described in this specification can be implemented in a laundry treatment apparatus including: a cabinet including a first opening and a second opening; a first cabinet door that is coupled to the cabinet and that is configured to open or close the first opening; a second cabinet door that is coupled to the cabinet and that is configured to open or close the second opening; a first washing apparatus that is located in the cabinet and that is configured to treat laundry introduced into an interior area of the first washing apparatus through the first cabinet door in a first direction; and a second washing apparatus that is configured to treat laundry introduced into an interior area of the second washing apparatus through the second cabinet door in a second direction, the second washing apparatus including: a tub that is accessible through the second opening in a state in which the second cabinet door is opened, that is configured to store water, and that includes a tub opening at a top of the tub, a tub cover that is coupled to the tub and that covers the tub opening, and a drum that is located in the tub and that is configured to rotate about a shaft, the shaft extending in the second direction, wherein the tub cover includes an air channel unit that is configured to transfer air between an interior area of the tub and an exterior area of the tub in a state in which the second washing apparatus is operational.

The foregoing and other implementations can each optionally include one or more of the following features, alone or in combination. In particular, one implementation includes all the following features in combination. The tub cover is configured to transfer air between the interior area of the tub and the exterior area of the tub only through the air channel unit. The tub cover includes: a tub cover body that is coupled to the tub, an introduction port through which laundry is introduced, and a tub door that is coupled to the tub cover body and that is configured to open or close the introduction port. The air channel unit includes: at least one air hole located in the tub cover body. The tub cover includes: a water supply port through which water is supplied into the interior area of the tub from an external water supply source, and wherein the introduction port is located at a first side of the tub cover and the water supply port and the air hole are located at a second side of the tub cover. The air hole is located between the introduction port and the water supply port. The air hole includes: a first air hole that has a first sectional area, and a second air hole that has a second sectional area, and wherein the second sectional area is larger than the first sectional area. The tub cover body includes a recess that is recessed from an upper surface of the tub cover body and that is configured to hold water discharged from the tub, and wherein the air hole includes a plurality of air holes that are located on a bottom surface of the recess. Each of the plurality of air holes includes a mesh. The laundry treatment apparatus further includes: a filter that is coupled to the recess. The tub door of the tub cover includes the air channel unit. The air channel unit includes: a hollow portion that is located at the tub door, a first air channel that is configured to transfer air between the interior area of the tub and the hollow portion, and a second air channel that is configured to transfer air between the exterior area of the tub and the hollow portion. The laundry treatment apparatus further includes: a sealing portion that is configured to seal a space between the introduction port and the tub door; and a sealing portion fixing part to which the sealing portion is coupled and that is located adjacent to the hollow portion. The sealing portion includes a closed loop, and wherein the air channel unit extends between an inner area of the closed loop and an outer area of the closed loop. The tub door includes: a frame that is configured to rotate and that is coupled to the tub cover body, a transparent window that is coupled to the frame, and a sealing portion that is coupled to an inner surface of the tub door and that is configured to seal the introduction port. The tub door further includes: a washing guide that is configured to guide water in the tub into a central area of the tub from an edge area of the tub in a state in which the drum is rotated. The air channel unit includes: at least one air hole located in the tub cover body. The air hole includes: a first air hole that has a first sectional area, and a second air hole that has a second sectional area, and wherein the second sectional area is larger than the first sectional area. The tub cover body includes a recess that is recessed from an upper surface of the tub cover body and that is configured to hold water discharged from the tub, and wherein the air hole includes a plurality of air holes that are located on a bottom surface of the recess. The laundry treatment apparatus further includes: a filter that is coupled to the recess, through which air introduced from the air holes passes, and that is configured to absorb water and bubbles introduced from the air holes.

The subject matter described in this specification can be implemented in particular examples so as to realize one or more of the following advantages. Comparing to a conventional laundry treatment apparatus, a laundry treatment apparatus can prevent negative pressure generated in a tub of the laundry treatment apparatus. In particular, the laundry treatment apparatus can prevent negative pressure generated in the tub regardless of water temperature. In addition, the laundry treatment apparatus can prevent a door from being opened by negative pressure generated in the tub. Moreover, the laundry treatment apparatus includes a particular structure that can transfer air between an interior area of the tub and an exterior area of the tub so prevent wash water or bubbles from being discharged out of the tub.

The details of one or more examples of the subject matter described in this specification are set forth in the accompanying drawings and the description below. Other potential features, aspects, and advantages of the subject matter will become apparent from the description, the drawings, and the claim.

BRIEF DESCRIPTION OF THE DRAWINGS

Like reference numbers and designations in the various drawings indicate like elements.

DETAILED DESCRIPTION

Figure 1:
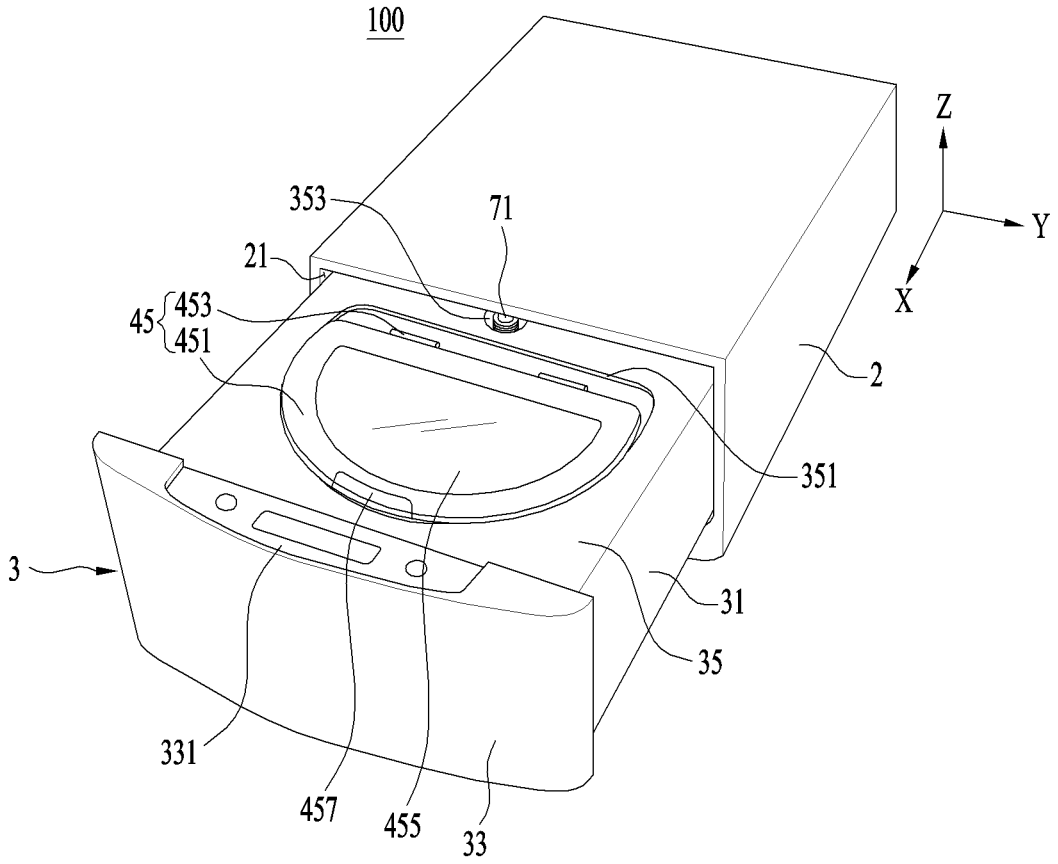
FIGS. 1 and 2 are diagrams illustrating an example laundry treatment apparatus.
Figure 2:
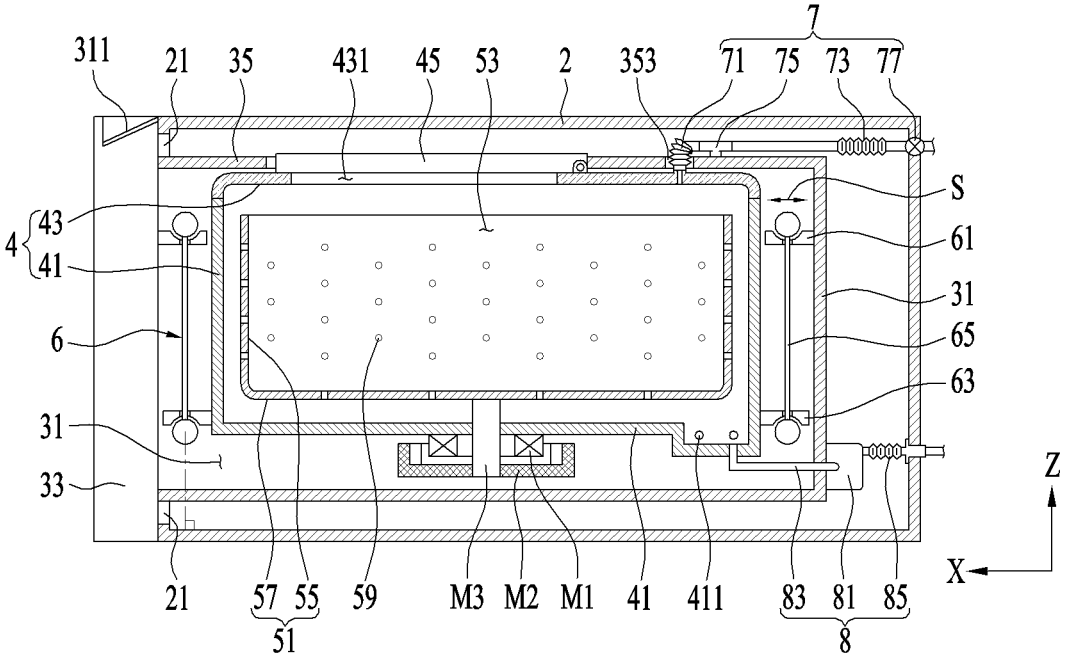

FIGS. 1 and 2 illustrate an example laundry treatment apparatus. The example laundry treatment apparatus can be a small-sized top loader. The laundry treatment apparatus, e.g., a small-sized washer can be used together with a washer or a dryer.

The laundry treatment apparatus may be located on a washer or a dryer, or may be located under the washer or the dryer. Of course, the laundry treatment apparatus may be provided together with a general washer or dryer in a single cabinet. Consequently, the volume or height of the laundry treatment apparatus may be smaller than that of the washer or the dryer.

In particular, a laundry treatment apparatus 100 may include a cabinet 2, a drawer 3 configured to be withdrawn from the cabinet, a tub 3 provided in the drawer for storing water, and a drum 5 rotatably provided in the tub for receiving laundry.

The cabinet 2 may be configured to define the external appearance of the laundry treatment apparatus. Alternatively, the cabinet 2 may be simply configured as space for receiving the drawer 3. In any case, the cabinet 2 may be provided at the front surface thereof with an open surface 21, through which the drawer 2 is inserted.

The drawer 3 includes a drawer body 31 configured to be inserted into the cabinet 2 through the open surface 21, a drawer panel 33 fixed to the front surface of the drawer body 31 for opening and closing the opening surface 21, and a drawer cover 35 configured to define the upper surface of the drawer body 31.

The drawer panel 33 may also serve as a handle for withdrawing the drawer body 31 from the cabinet 2, since the drawer panel 33 is fixed to the front surface of the drawer body 31.

The drawer panel 33 may be provided with a control panel 331 for allowing a user to input a control command related to the operation of the laundry treatment apparatus 100 and for displaying a message related to the operation of the laundry treatment apparatus to the user.

The drawer body 31 may be inserted into the cabinet 2 through the open surface 21. The shape of the drawer body 31 is not particularly restricted, as long as the drawer body 31 provides space for receiving the tub 4. FIG. 1 shows a drawer body 31 formed in an empty hexahedral shape by way of example.

The drawer cover 35 is provided with a first through hole 351 and a second through hole 353, through which the inside and outside of the drawer body 31 communicate with each other. The first through hole 351 is provided to introduce laundry, and the second through hole 353 is provided to supply water necessary to wash the laundry, which will be described in detail later.

As shown in FIG. 2, the tub 4 includes a tub body 41 located in the drawer body 31 for storing water and a tub cover 43 configured to define the upper surface of the tub body 41.

The tub body 41 may be configured as a cylindrical shape that is open at the upper surface thereof. A heater 411 for heating water may be provided in the tub body 41.

The diameter of the tub body 41 is greater than the height of the tub body 41. In other words, the vertical length of the tub body 41 is greater than the horizontal length of the tub body 41.

The tub cover 43 may include an introduction port 431, through which the inside and outside of the tub body 41 communicate with each other, and a supply port 433, through which water is supplied into the tub body 41.

The tub cover 43 covers the open upper surface of the tub body 41 such that the inside and outside of the tub communicate with each other through the a431.

The introduction port 431 may be provided under the first through hole 351 provided in the drawer cover, and the supply port 433 may be provided under the second through hole 353 provided in the drawer cover.

The introduction port 431 is for supplying laundry into the tub body 41 or withdrawing the laundry from the tub body 41. The introduction port 431 is opened and closed by a door 45.

Figure 3:
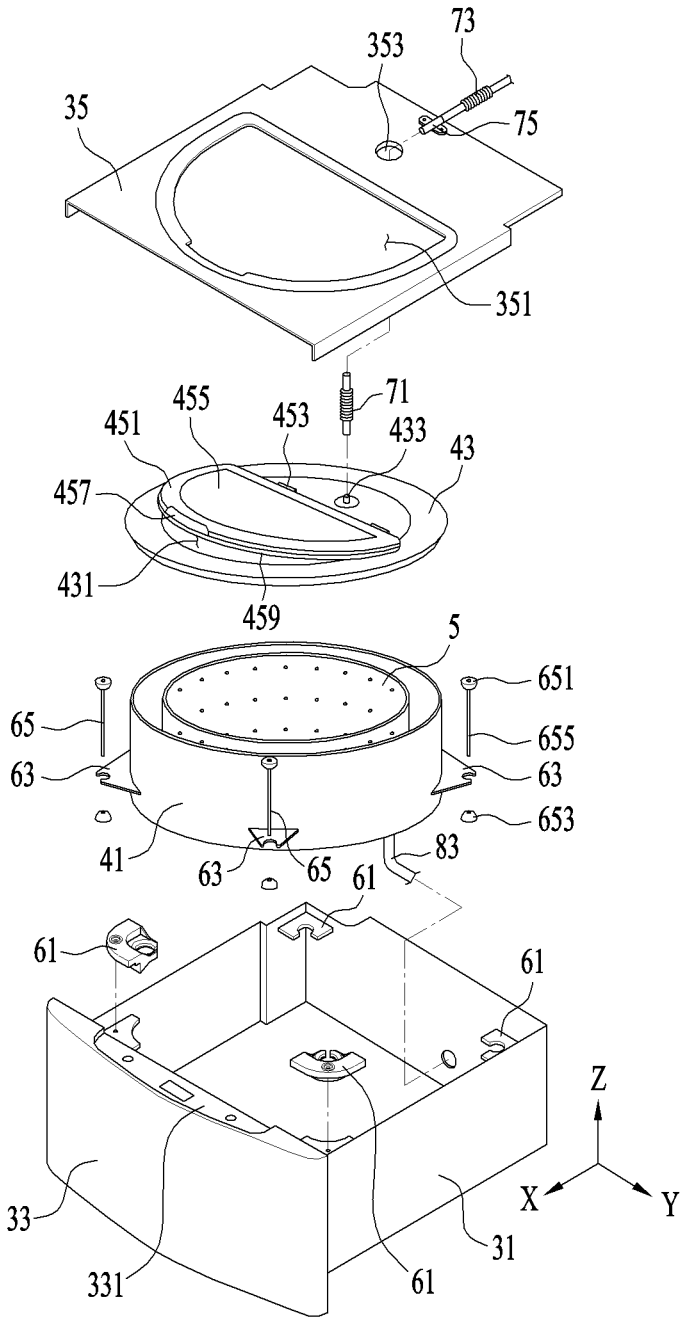
FIG. 3 is a diagram illustrating an example drawer, an example tub, and an example drum.
Figure 4:
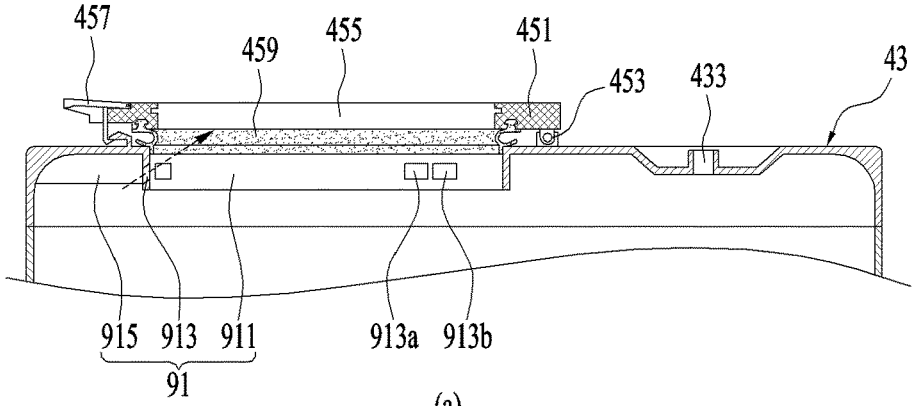
FIG. 4 is a diagram illustrating an example washing unit of a laundry treatment apparatus.
Figure 4:
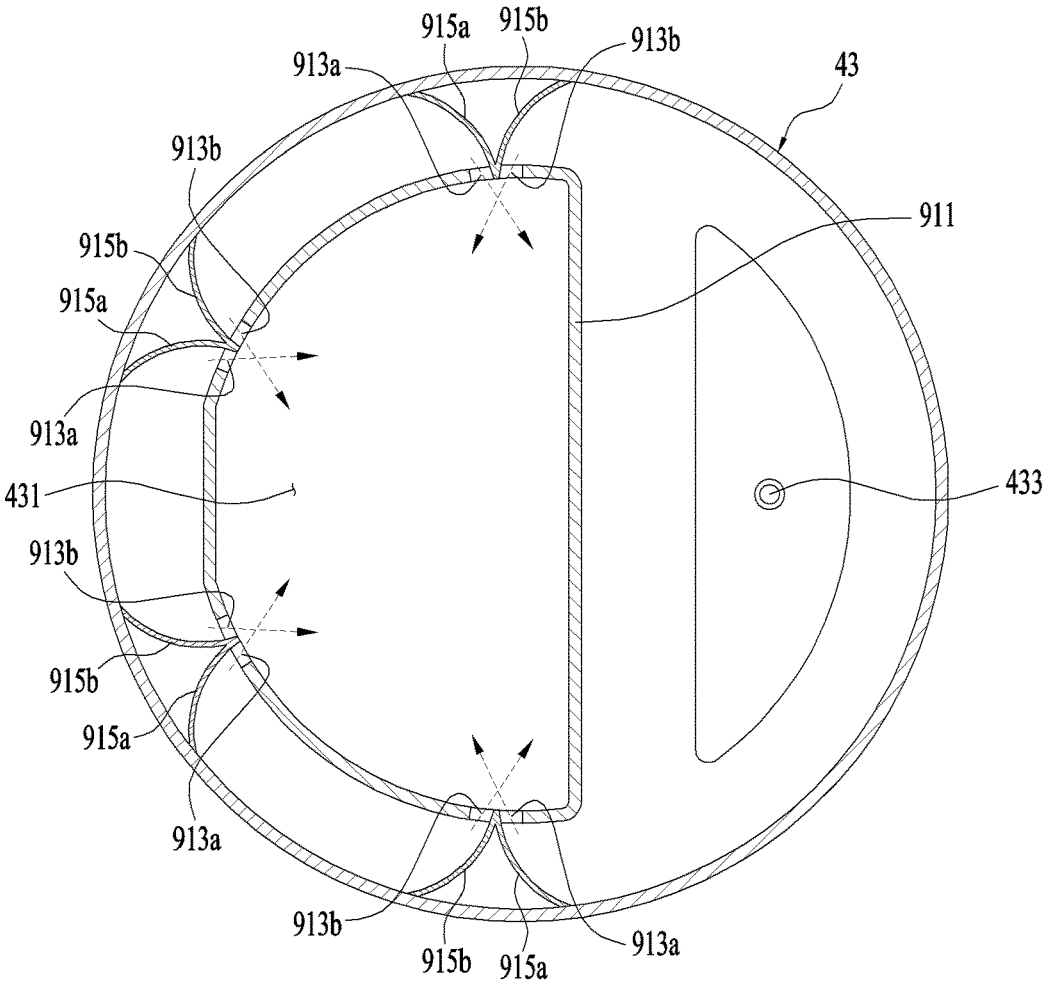

FIG. 3 illustrates an example drawer, an example tub, and an example drum. FIG. 4 illustrates an example washing unit of a laundry treatment apparatus.

As shown in FIGS. 3 and 4, the door 45 may include a frame 451 rotatably coupled to the tub cover 43 via a hinge 453, a window 455 provided in the frame, and a door handle 457 for separably coupling the frame 451 to the tub cover 43.

The window 455 may be made of a transparent material such that the user can check the interior of the tub 41 when the drawer 3 is withdrawn from the cabinet 2.

One end of the door 45 is connected to the upper surface of the tub cover 43 such that the door 45 is turned to open and close the introduction port 431. When the door 45 closes the introduction port 43, the tub 4 is sealed.

The space in the tub 4 is not completely physically sealed such that air cannot flow between the inside and the outside of the tub 4. The reason for this is that air can flow between the inside and the outside of the tub 4 through a tub air channel unit or a door air channel unit, which will be described later.

The space in the tub 4 may be described as being sealed in the case in which the amount of air that can flow through a communication part between the inside and the outside of the tub 4 per unit time is much less than the amount of air that must flow between the inside and the outside of the tub 4 per unit time in order to reduce the difference in pressure between the inside and the outside of the tub 4, which instantaneously and abruptly occurs.

Therefore, the space in the tub 4 may be instantaneously sealed. That is, when a difference in pressure between the inside and the outside of the tub 4 occurs due to abrupt compression or expansion of air in the tub 4 in the state in which the door 45 is closed, the amount of air per unit time that can flow between the inside and the outside of the tub 4 is much less than the amount of air per unit time that must flow between the inside and the outside of the tub 4 in order to reduce the difference in pressure between the inside and the outside of the tub 4. As a result, negative pressure or positive pressure may be instantaneously and abruptly generated in the tub 4.

A hook 450 provided at the other end of the door 45 is fastened to a hook hanger 430 provided at the tub cover 43 such that the door 45 is fixed to the tub cover 43. The hook hanger 430 may protrude such that the end of the hook 450 is caught by the hook hanger 430.

Figure 11:
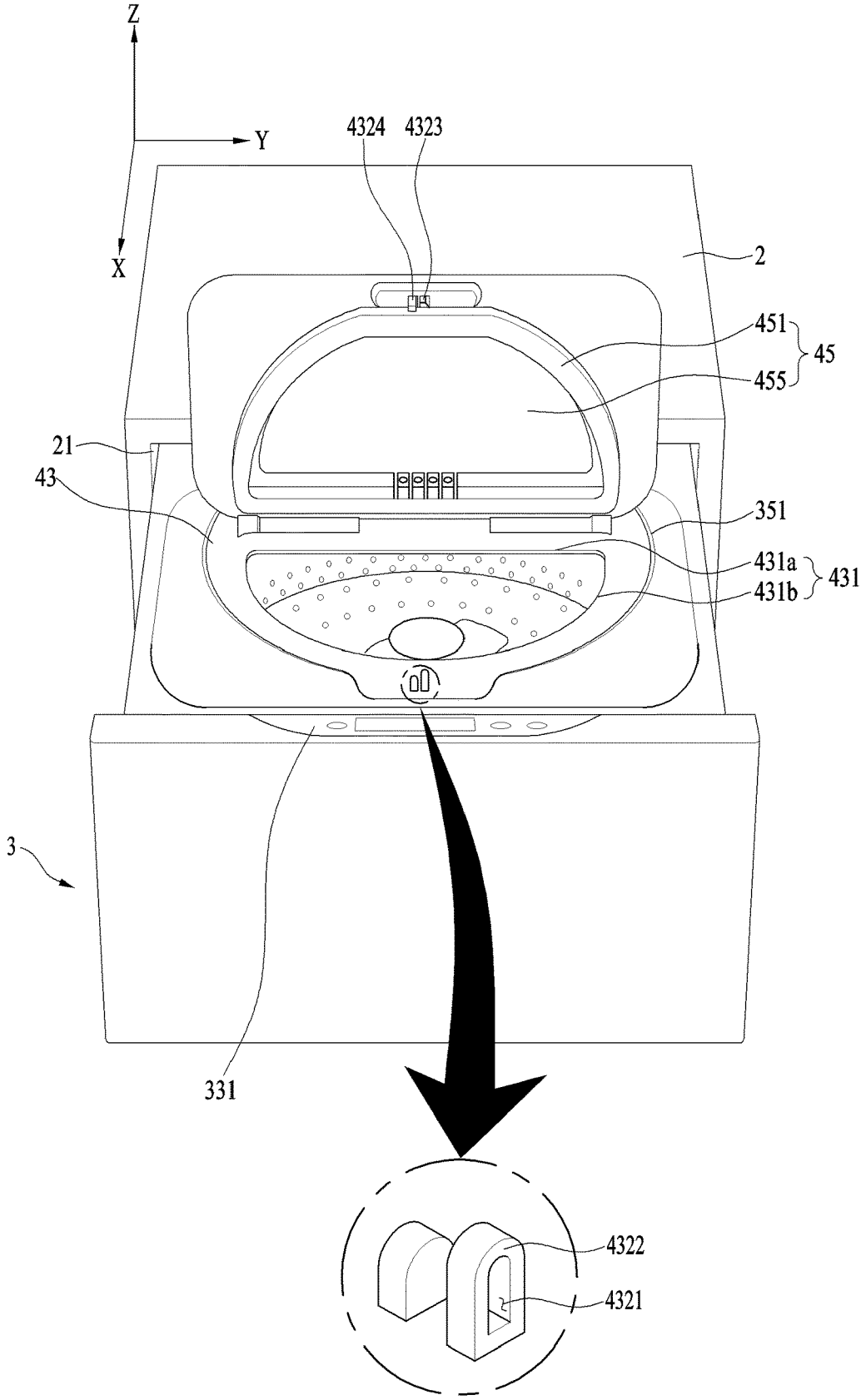
FIG. 11 is a diagram illustrating an example door of the laundry treatment apparatus in a state in which the example door is open.

Alternatively, referring to FIG. 11, the door 45 may be locked and unlocked by a push/open button type locking unit 432. That is, when the upper surface of the door 45 is pushed to close the door 45, the door 45 is locked, and when the upper surface of the door 45 is pushed again to open the door 45, the door 45 is unlocked.

The locking unit 432 includes a latching protrusion 4322 protruding from the upper surface of the tub cover 43, the latching protrusion 4322 having a fastening hole 4321, and an unlocking part 4323 provided at the inner surface of the door 45. When a user applies force in the direction in which the latching protrusion 4322 is inserted, the unlocking part 4323 is inserted into the fastening hole 4321 to fix the latching protrusion 4322. When the user applies force again in the direction in which the latching protrusion 4322 is inserted, the unlocking part 4323 is separated from the fastening hole 4321, whereby the coupling between the latching protrusion 4322 and the unlocking part 4323 is released. Alternatively, the latching protrusion 4322 may be provided at the door 45, and the unlocking part 4323 may be provided at the tub cover 43.

In some implementations, the door 45 or the tub cover 43 may be provided with an opening part 4324 for increasing the distance between the door 45 and the tub cover 43. The opening part 4324 is provided at the inner surface of the door 45 to provide elastic force toward the tub cover 43. When the door is unlocked, therefore, the door is pushed from the tub cover.

The laundry treatment apparatus is different from a general top loading type washer in that, in the general top loading type washer, the upper surface of the tub is open and the interior of the tub communicates with the interior of the cabinet, whereas, in the laundry treatment apparatus, however, the upper surface of the tub is closed and the introduction port 431 formed in the upper surface of the tub 4 is sealed by the door 45 rotatably provided at the upper surface of the tub cover 43, whereby the interior of the tub 4 does not communicate with the interior of the cabinet. That is, the interior of the tub 4 is sealed.

The reason that the upper surface of the tub is closed in the laundry treatment apparatus is that a large amount of bubbles may be generated in the tub 4 due to the rotation of the drum and the generated bubbles may flow outward through the upper surface of the tub, since the height of the tub 4 is smaller than the diameter of the tub 4. In order to solve this problem, the upper surface of the tub is closed.

In some implementations, in order to prevent the water in the tub body 41 from being discharged out of the tub body 41 through the introduction port 431, any one selected from between the frame 451 and the tub cover 43 may be further provided with a sealing part 459 for sealing the gap between the frame 451 and the introduction port 431 when the door 45 closes the introduction port 431.

The tub 4 having the above structure is coupled to the drawer body 31 via a tub support unit 6. The tub support unit 6 may include a first support part 61 provided at the drawer body 31, a second support part 63 provided at the tub body 41, and a connection part 65 for connecting the first support part and the second support part to each other.

The connection part 65 may include a first connection part 651 located in the first support part 61, a second connection part 653 for supporting the second support part 63, and a bar 655 for connecting the first connection part and the second connection part to each other.

The first connection part 651 may be formed in a shape in which the first connection part 651 is movable in the first support part 61 while being 651 located in the first support part 61, and the second connection part 653 may be formed in a shape in which the second connection part 653 is movable in the second support part 63 while supporting the second support part 63.

FIG. 2 shows the case in which each of the first and second connection parts 651 and 653 is formed in a spherical shape by way of example, and FIG. 3 shows the case in which the surface of each of the connection parts 651 and 653 that contacts a corresponding one of the support parts 61 and 63 is formed in a hemispherical shape by way of example.

In some implementations, as shown in FIG. 2, the bar 655 may be configured to be perpendicular to the bottom surface of the cabinet 2 (i.e. configured to be parallel to the height direction Z of the cabinet and to be perpendicular to the bottom surface of the drawer).

In some implementations, at least three tub support units 6 are provided to couple the tub body 41 to the drawer body 31, and the bars 655 are perpendicular to the bottom surface of the cabinet. Consequently, it is possible to increase the distance between the tub cover 43 and the drawer cover 35, compared to the case in which the bars 655 are inclined from the Z axis by a predetermined angle.

Consequently, the tub support units 6 may minimize the possibility of the tub cover 43 colliding with the drawer cover 35 even when the tub body 41 vibrates in the drawer body 31.

In some implementations, in the case in which the bars 655 are perpendicular to the bottom surface of the drawer, at least one of the first and second support parts 61 and 63 may be separably provided at the drawer body 31.

In the case in which at least three tub support units 6 are provided and the first support part 61 and the second support part 63 are fixedly provided at the drawer body 31, a worker who wishes to fix the tub 41 to the drawer body 31 must insert the tub body 41 into the drawer body 31 such that the second support part 63 does not interfere with the first support part 61 and then rotate the tub body 41 such that the second support part 63 is located on the vertical line passing through the first support part 61 in order to couple the first connection part 651 to the first support part 61.

In the case in which the bars 655 of the tub support units 6 are perpendicular to the bottom surface of the drawer, however, the gap S between the outer circumferential surface of the tub body 41 and the inner circumferential surface of the drawer body 41 may be minimized, thereby minimizing the volume of the laundry treatment apparatus 100, but the efficiency in assembly of the first connection part 651 and the first support part 61 performed through the above procedure may be deteriorated. This problem may be solved in the case in which the first support part 61 is separably provided at the drawer body 41.

The drum 5, provided in the tub 4, may include a cylindrical drum body 51 having an open surface 53 provided in the upper part thereof. The open surface 53 is located under the introduction port 431. Consequently, laundry supplied through the introduction port 431 is introduced into the drum body 51 through the open surface 53.

In some implementations, the drum body 51 may be provided in the bottom surface 57 and the circumferential surface 55 thereof with a plurality of drum through holes 59, through which the inside of the drum body 51 and the tub body 41 communicate with each other.

The drum body 51 is rotated in the tub body 41 by a driving unit M (e.g. a motor). The driving unit M may include a stator M1 fixed to the bottom surface of the tub body while being located outside the tub body 41, a rotor M2 configured to be rotated by a rotating field provided by the stator, and a shaft M3 extending through the bottom surface of the tub body 41 for connecting the bottom surface 57 of the drum and the rotor M2 to each other. In this case, the shaft M3 may be perpendicular to the bottom surface of the tub body 41.

In the laundry treatment apparatus 100 having the above structure, water is supplied to the tub 4 through a water supply unit 7, and the water stored in the tub 4 is discharged out of the cabinet 2 through a drainage unit 8.

As shown in FIG. 2, the water supply unit 7 may include a first water supply pipe 71 connected to the supply port 433, which is provided at the tub cover, a second water supply pipe 73 connected to a water supply source located outside the cabinet, and a connection pipe 75 fixed to the tub cover 43 for connecting the first water supply pipe and the second water supply pipe to each other.

The first water supply pipe 71 may connect the supply port 433 and the connection pipe 75 to each other through the second through hole 353, which is provided in the drawer cover 35, and may be configured as a bellows pipe so as to prevent the first water supply pipe 71 from being separated from the connection pipe 75 when the tub 4 vibrates (see FIG. 3).

In addition, the second water supply pipe 73 may also be configured as a bellows pipe so as to prevent the second water supply pipe 72 from being separated from the connection pipe 75 when the drawer is withdrawn from the cabinet 2. The second water supply pipe 73 is opened and closed by a water supply valve 77 under the control of a controller 101.

Unlike what is shown in FIG. 2, however, the water supply unit 7 may include a single water supply pipe for connecting a water supply source located outside the cabinet and the supply port 433, which is provided at the tub cover. In this case, the water supply pipe may be configured as a bellows pipe.

The drainage unit 8 may include a drainage pump 81 fixed to the drawer body 31, a first drainage pipe 83 for guiding the water from the tub body 41 to the drainage pump 81, and a second drainage pipe 85 for guiding the water discharged from the drainage pump 81 out of the cabinet 2. In this case, the second drainage pipe 85 may be configured as a bellows pipe. The controller 101 controls the operation of the drainage pump 81 such that water from the tub 4 is drained to the outside via the first drainage pipe 83, the drainage pump 81, and the second drainage pipe 85.

In the laundry treatment apparatus 100 having the above structure, laundry is introduced into the drum 5, water and detergent are supplied into the tub 4, and the drum 5 is rotated by the driving unit to wash the laundry.

During the rotation of the drum 5, a stream of water is generated in the tub 4. Consequently, bubbles generated when the detergent is dissolved during washing of the laundry or dirt separated from the laundry may remain on the door 45 or the drum 5 after the completion of washing.

If bubbles or dirt remain on the inner surface of the door 45 or the circumferential surface of the drum after the completion of washing, the user may misjudge that washing of the laundry has not been completed or may suspect that the laundry treatment apparatus 100 is out of order.

In order to solve the above problem, the laundry treatment apparatus 100 may further include at least one selected from between a washing unit 91 for removing foreign matter (e.g. bubbles or dirt) from the door 45 and a spray unit 93 for preventing the generation of bubbles and washing the drum.

The washing unit 91 shown in FIG. 4 is a machine for washing the door 45 using centrifugal force generated during the rotation of the drum 5.

The shaft M3 of the drum 5, which forms the center of rotation, is perpendicular to the bottom surface of the tub body. When the drum 5 is rotated, therefore, the water in the tub 4 moves upward along the circumferential surface of the tub body 41 by centrifugal force and then moves toward the introduction port 431 along the tub cover 43. In this example, the washing unit 91 is a machine for discharging the water that has moved to the tub cover 43 by centrifugal force toward the door 45 to wash the door 45.

The washing unit 91 of FIG. 4 may include a blocking wall 911 protruding from the tub cover 43 toward the upper surface of the drum 5, a guide 915 extending from the edge of the tub cover 43 toward the blocking wall 911, and a discharge part 913 formed through the blocking wall for discharging the water moving along the guide 915 toward the door 45.

The blocking wall 911 may be configured to surround the entirety of the introduction port 431 or to intermittently surround the introduction port 431. The expression "the blocking wall intermittently surrounds the introduction port" means that a plurality of blocking walls is arranged along the edge of the introduction port at intervals.

FIG. 4(*b*) shows the case in which the blocking wall 911 is configured to surround the entirety of the introduction port 431. In this case, the blocking wall 911 may protrude from the edge of the introduction port 431 toward the drum 5.

In some implementations, in the case in which the door 45 is rotatably coupled to the upper surface of the tub cover 43, with the result that the inner surface of the door 45 (i.e. the surface of the door that contacts water) is at a higher position than the discharge part 913, the discharge part 913 may be inclined at a predetermined angle so as to discharge water toward the door 45.

Furthermore, in the case in which the door 45 is provided with a transparent window 455, the user may check whether foreign matter remains through the window 455. Consequently, the discharge part 913 may be inclined at a predetermined angle so as to discharge water toward the window 455.

The guide 915 may include a first guide 915*a* for guiding water moving toward the edge of the tub cover 43 to the discharge part 913 when the drum 5 is rotated in the clockwise direction and a second guide 915*b* for guiding water moving toward the edge of the tub cover 43 to the discharge part 913 when the drum 5 is rotated in the counterclockwise direction.

In the case in which the discharge part 913 includes a single hole formed through the blocking wall 911, the guides 915*a* and 915*b* guide water to the discharge part 913. In the case in which the discharge part 913 includes a first discharge part 913*a* and a second discharge part 913*b* formed through the blocking wall 911, however, the first guide 915*a* may be configured to guide water to the first discharge part 913*a*, and the second guide 915*b* may be configured to guide water to the second discharge part 913*b*.

The direction in which the water moves along the first guide 915*a* is opposite the direction in which the water moves along the second guide 915*b*. Consequently, the washing unit 91 may wash the door 45 irrespective of the rotational direction of the drum as long as the number of rotations of the drum 5 is equal to or greater than a predetermined reference number of rotations (e.g. the number of rotations at which the water in the tub body moves upward to the tub cover due to centrifugal force).

In addition, the discharge parts 913*a* and 913*b* may be inclined at a predetermined angle such that the trajectory of the water discharged from the first discharge part 913*a* and the trajectory of the water discharged from the second discharge part 913*b* intersect. In this case, the washing range of the washing unit 91 may be increased.

A plurality of washing units 91 may be arranged along the edge of the introduction port 431. The washing units 91 may be arranged so as to surround the introduction port 431. Furthermore, at least two of the washing units 91 may be opposite each other in order to increase the washing force of the washing units 91.

Figure 5:
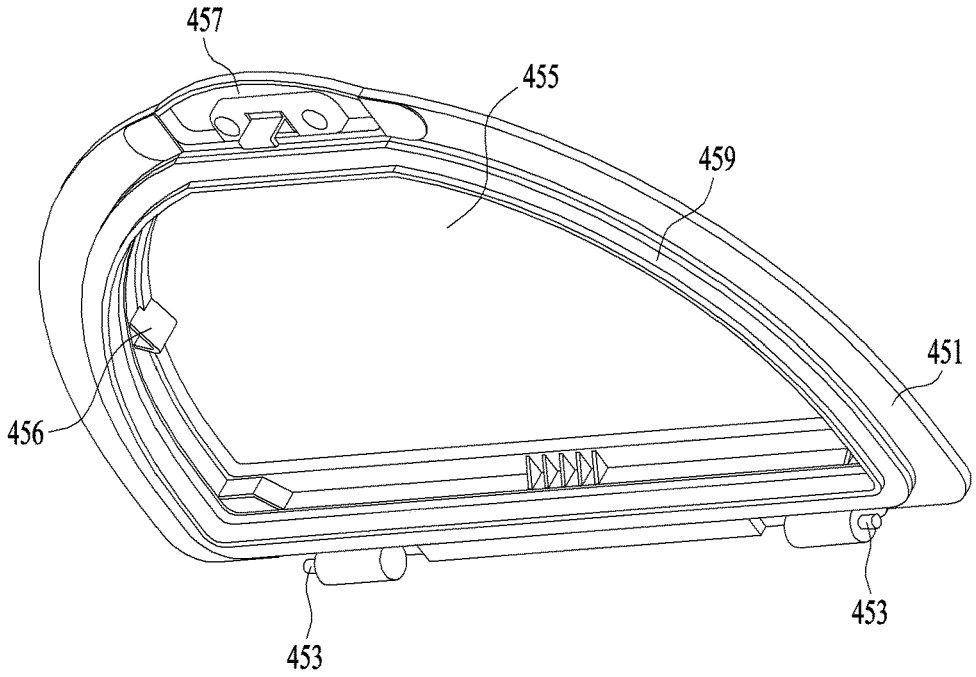
FIG. 5 is a diagram illustrating an example washing guide of a laundry treatment apparatus.
Figure 5:
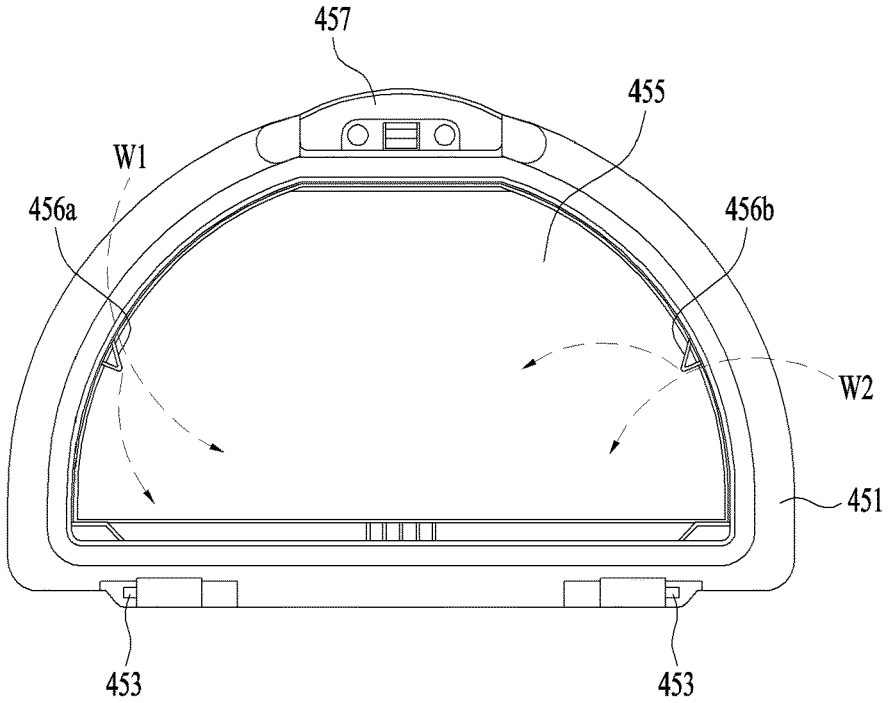

FIG. 5 illustrates an example washing guide of a laundry treatment apparatus. Foreign matter remaining on the door 45 may be removed using a washing guide 456 shown in FIG. 5. The washing guide 456 may be provided at the edge of the window 455. During the rotation of the drum, the water in the tub moves from the bottom surface of the tub to the edge of the frame 451 by centrifugal force and, in addition, moves along the edge of the frame 451. In the case in which the washing guide 456 is provided at the edge of the window 455, some of the water moving along the edge of the frame 451 may be guided toward the center of the window 455 (W1 and W2). In this example, therefore, it is possible to prevent foreign matter from remaining on the window through the washing guide 456.

In order to maximize the washing area, however, the washing guide 456 may include a first washing guide 456*a* and a second washing guide 456*b* provided symmetrically thereto on the basis of a line of symmetry Q of the door 45 (see FIG. 5(*b*)).

In this example, either the washing unit 91 or the washing guide 456 may be included, or both the washing unit 91 and the washing guide 456 may be included.

Figure 6:
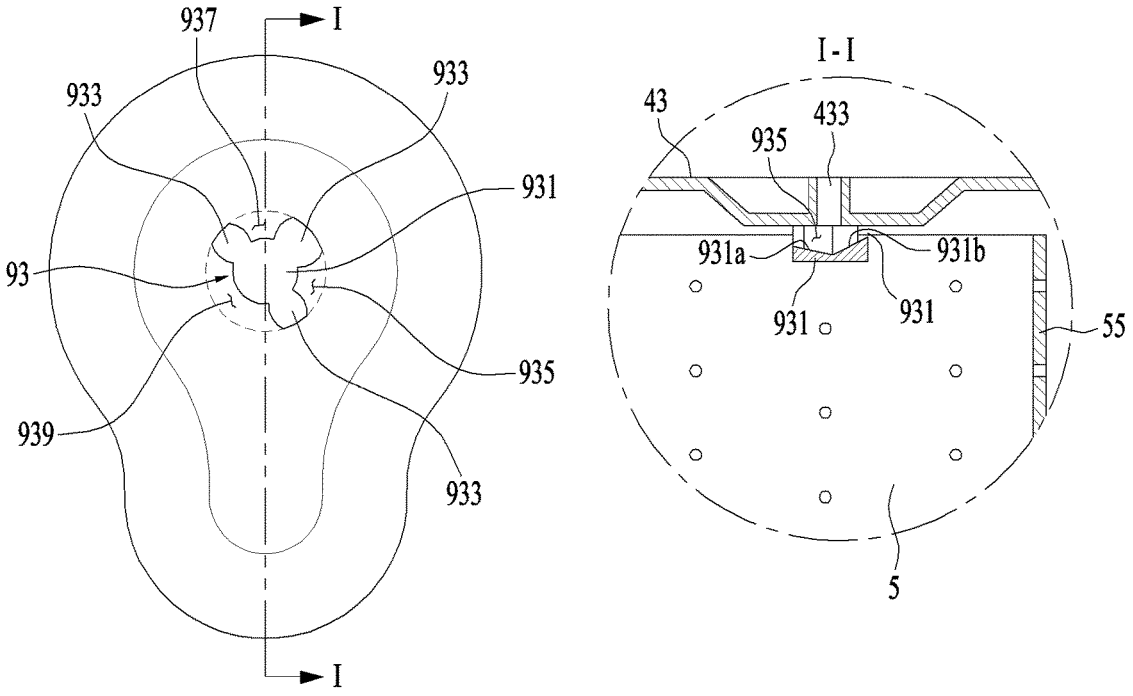
FIG. 6 is a diagram illustrating an example spray unit of a laundry treatment apparatus.

FIG. 6 illustrates an example spray unit 93 of a laundry treatment apparatus. The spray unit 93 is for spraying water introduced through the supply port 433 to the drum 5 to wash the inner circumferential surface of the drum or remove bubbles generated in the drum.

In this example, the spray unit 93 sprays water in at least two different directions. The spray unit 93 of FIG. 6 may include an extension part 933 protruding from the tub cover 43 so as to surround the supply port 433, a body 931 fixed to the extension part 933 so as to be spaced apart from the supply port 433 by a predetermined distance, and at least two spray ports formed through the extension part 933 for discharging water from the extension part 933.

FIG. 6 shows the case in which the spray unit 93 includes a first spray port 935, a second spray port 937, and a third spray port 939 by way of example. The spray ports 935, 937, and 939 may be spaced apart from one another by different distances.

In some implementations, at least one of the spray ports 935, 937, and 939 may be configured to spray water toward the circumferential surface 55 of the drum in order to wash the circumferential surface of the drum, and at least one of the spray ports may be configured to spray water toward the bottom surface of the drum in order to remove bubbles generated in the drum.

In order to increase the pressure of the water discharged through the spray ports 935, 937, and 939, the body 931 may be provided with an inclined surface that is inclined upward toward the spray ports 935, 937, and 939.

The inclined surface may include a first inclined surface 931*a* that is inclined upward from the surface of the body 931 toward the first spray port 935, a second inclined surface 931*b* that is inclined upward from the surface of the body toward the second spray port 937, and a third inclined surface that is inclined upward from the surface of the body 931 toward the third spray port 939.

The sectional area of a water channel is gradually decreased from the center of the body 931 toward the spray ports 935, 937, and 939 due to the inclined surfaces 931*a* and 931*b*. In this example, therefore, the pressure of water discharged through the spray ports 935, 937, and 939 is increased, whereby the spray unit 93 may spray water a long distance.

In some implementations, the spray unit 93 having the above structure may be spaced apart from the center of rotation of the drum 5 by a predetermined distance. If the spray unit 93 is located at the same position as the center of rotation of the drum, the spray unit 93 can spray water to the edge of the drum, but it is difficult for the spray unit 93 to spray water to the center of rotation of the drum, which is located under the spray unit 93.

The body 931 may be provided with a through hole to supply water to the center of rotation of the drum. In this case, however, the pressure of the water discharged through the spray ports 935, 937, and 939 may be reduced.

In the case in which the spray unit 93 is provided so as not to be located on a straight line passing through the center of rotation of the drum, it is possible to supply water to the entire area of the drum without reducing the pressure of the water sprayed from the spray unit 93.

Figure 7A:
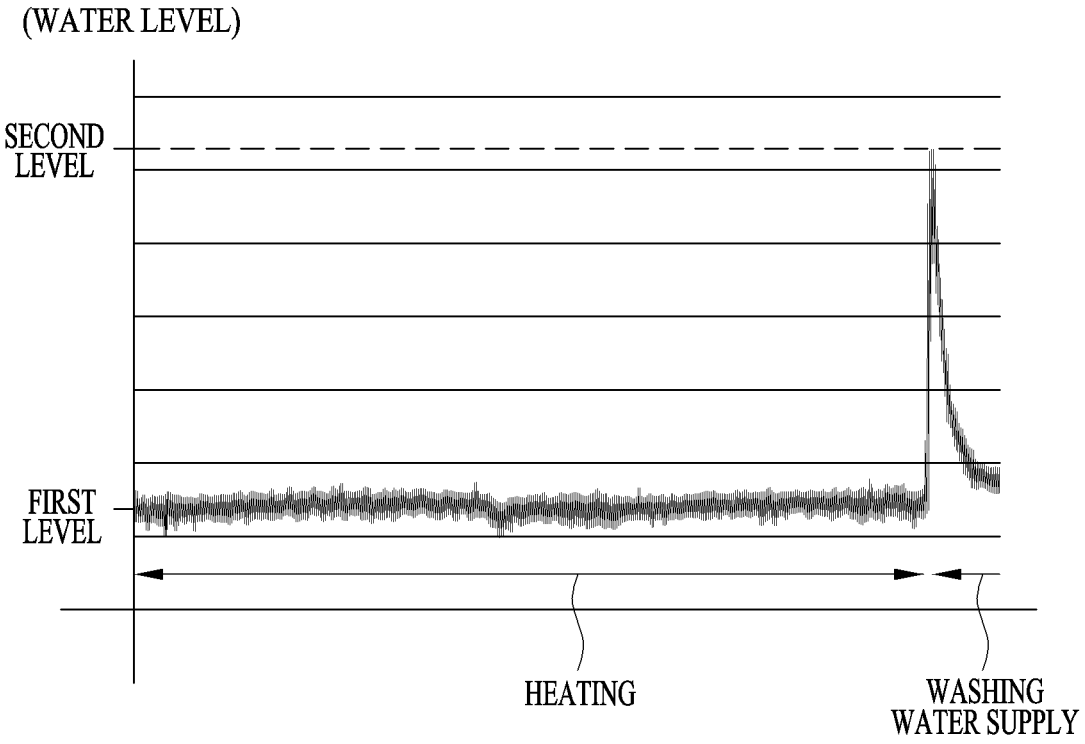
FIG. 7A is a graph illustrating an example change in a level of water in a tub in a state in which wash water is supplied for main washing.

FIG. 7A illustrates a graph of an example change in a level of water in a tub in a state in which wash water is supplied for main washing. When water stored to a first level in the tub 4 is heated and then water is supplied into the tub 4 for a subsequent step, the level of water in the tub 4 is abruptly increased from the first level to a second level.

When the door 45 is closed, the space in the tub 4 is sealed. As previously described, however, the space in the tub 4 is not physically sealed, and a detailed description thereof will be omitted.

When the water stored in the tub 4 is heated and then cold water is additionally supplied, the air in the tub 4 is instantaneously and abruptly condensed, with the result that high negative pressure is instantaneously and abruptly generated in the sealed tub 4, whereby the level of water stored in the tub is increased.

In this case, the tub cover and the door may be temporarily or permanently deformed, with the result that an unnecessary gap may be formed between the tub cover and the door.

In addition, the negative pressure instantaneously and abruptly generated in the tub may be applied to the door, which is configured to be locked and unlocked by the push/open button type locking unit, such that the door is moved toward the inside of the tub, whereby the locking unit may be unlocked. In other words, when the negative pressure generated in the tub is higher than the force applied by the user in order to open the door, the door may be pulled, with the result that the door may be opened.

Hereinafter, a method of minimizing the negative pressure that may be instantaneously and abruptly generated in the tub 4 will be described.

Figure 7B:
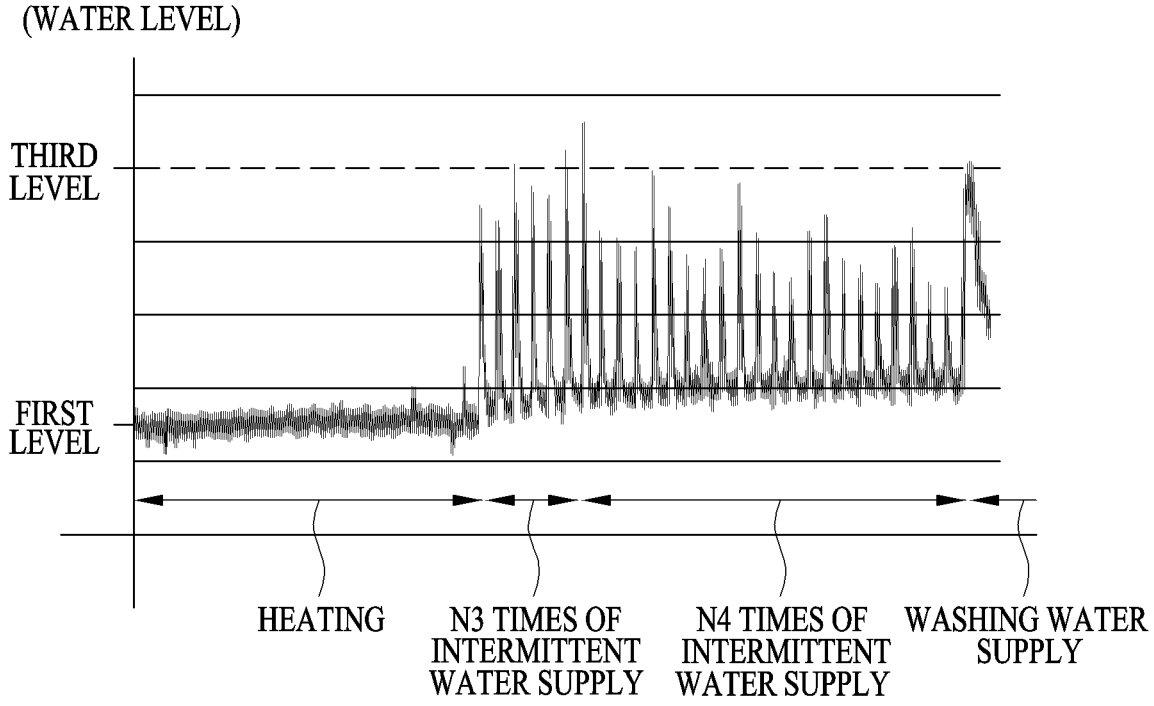
FIG. 7B is a graph illustrating an example change in a level of water in a tub in a state in which wash water is supplied for intermittent washing.
Figure 8:
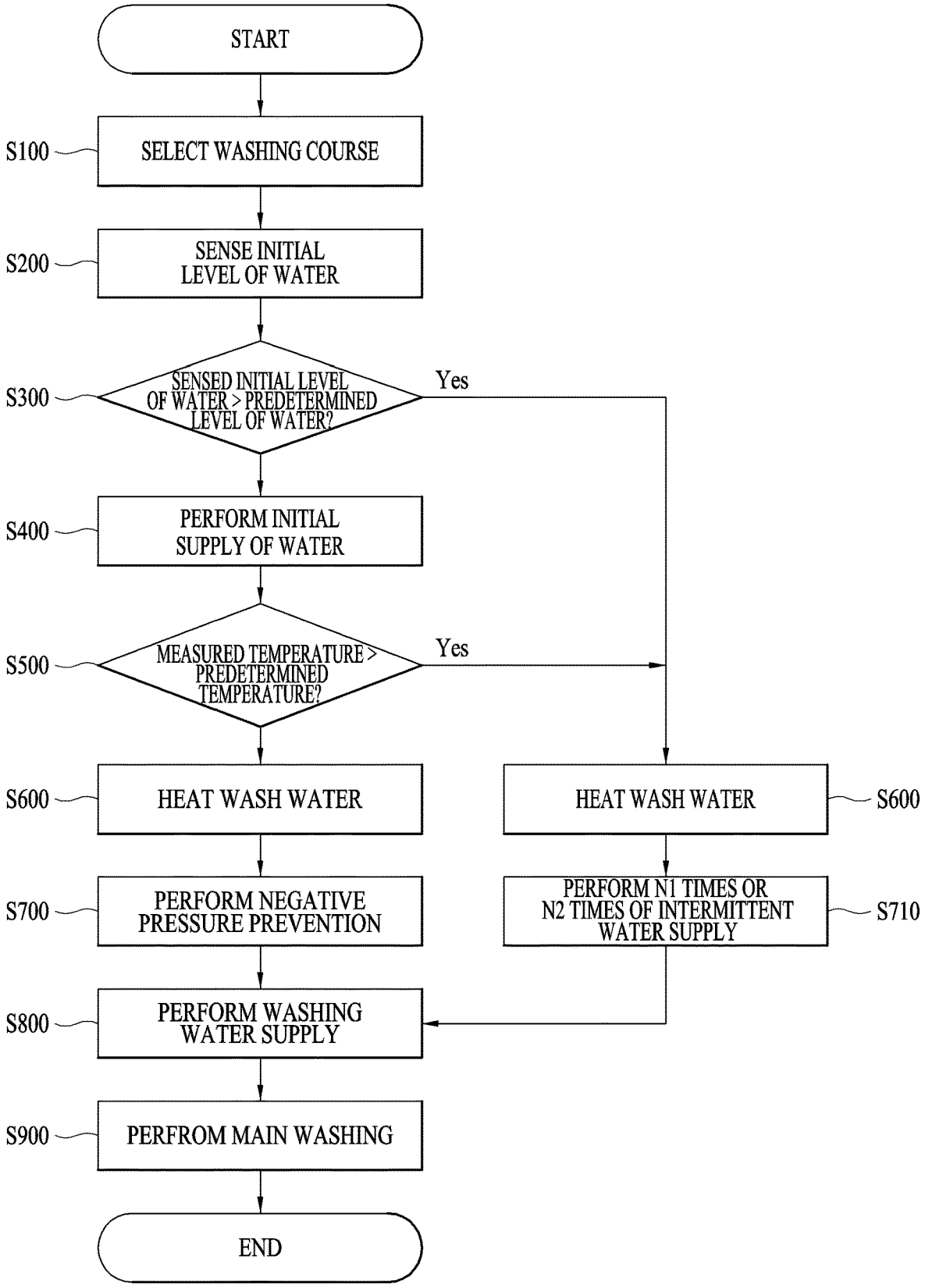
FIG. 8 is a flowchart illustrating an example method of controlling a laundry treatment apparatus.
Figure 10:
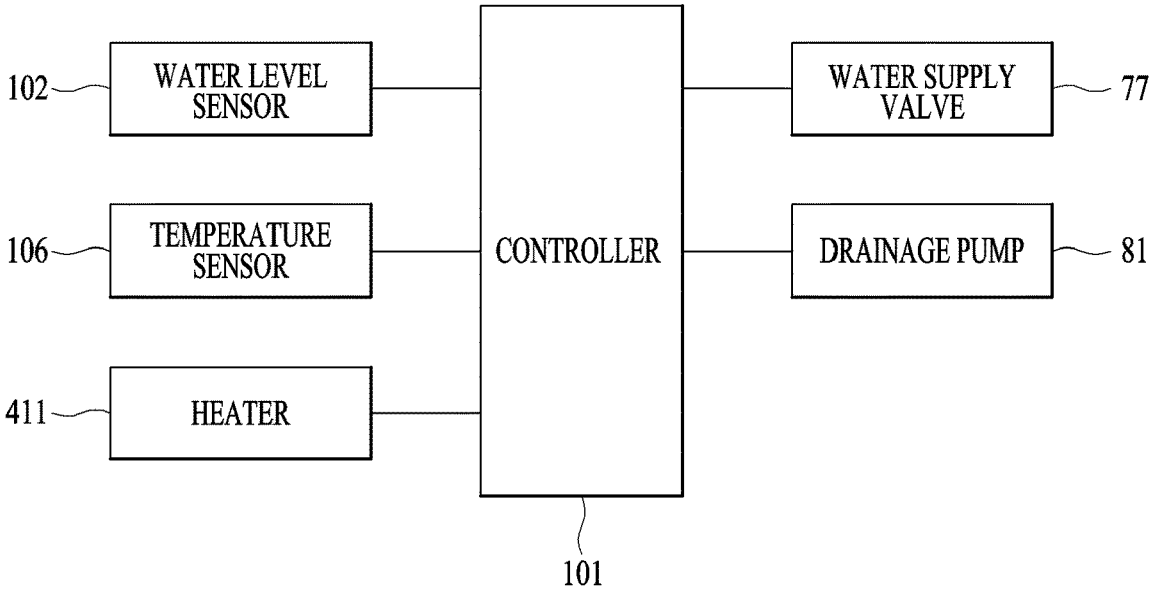
FIG. 10 is a diagram illustrating an example laundry treatment apparatus.

FIG. 7B illustrates a graph of an example change in a level of water in a tub in a state in which wash water is supplied for intermittent washing. FIG. 8 illustrates a flowchart of an example method of controlling a laundry treatment apparatus. FIG. 10 illustrates an example laundry treatment apparatus.

Referring to FIGS. 8 and 10, the method of controlling the laundry treatment apparatus may include a washing course selection step (S100) of selecting a heating course in which laundry is heated, a water supply step (S400) of supplying water to the tub 4, a heating step (S600) of heating the water stored in the tub 4, a negative pressure prevention step (S700) of performing intermittent water supply to supply water into the tub 4 for a first predetermined amount of time and to interrupt the supply of water for a second predetermined amount of time, a washing water supply step (S800) of supplying water to a washing level for washing after the negative pressure prevention step, and a main washing step (S900).

When a user selects a washing course at the washing course selection step (S100), the controller 101 performs control such that a washing cycle is performed according to the selected washing course.

The washing cycle is a cycle of supplying water containing detergent into the tub and rotating the drum to wash laundry using frictional force generated on the inner circumferential surface of the drum and bending force caused by a stream of water generated in the tub.

The heating course is a course in which water is supplied into the tub 4 to a predetermined level before the washing cycle of washing the laundry and in which the wash water is heated to a predetermined temperature using the heater 411 provided in the tub 4 to remove microorganisms from the laundry and soak the laundry.

In this case, the wash water may be heated to about 90° C. or higher. The reason for this is that, when water is heated to about 90° C. or higher, germs or microorganisms present in laundry can be effectively killed.

The heating course may be a boiling course in which wash water is boiled. In this case, the temperature of the wash water heated by the heater may be 100° C.

At the water supply step (S400), the amount of water that is supplied is set depending on the weight of laundry sensed at a laundry weight sensing step performed before the heating course or the water supply step (S400).

The water supply step (S400) may include a temperature sensing step of sensing the temperature of water supplied into the tub 4.

At the temperature sensing step, the temperature of water supplied into the tub 4 may be sensed using a temperature sensor 106 provided in the tub 4. Alternatively, the temperature of water supplied into the tub 4 may be measured using a temperature sensor 106 provided in the first or second water supply pipe.

When the temperature of water sensed at the temperature sensing step is lower than a predetermined temperature, intermittent water supply may be repeated N1 times (S500 and S710). In the case in which intermittent water supply is repeated N1 times, water is supplied to a washing level for washing without performing the negative pressure prevention step (S700), and then the main washing step is performed.

When the temperature of water sensed at the temperature sensing step is higher than the predetermined temperature, the negative pressure prevention step (S700) is performed.

For example, the predetermined temperature may be about 10° C., which is the temperature of the water supplied from an external water supply source.

When cold water having a temperature of about 10° C. supplied from the external water supply source is added to the water heated at the heating step (S600), the water in the tub is cooled due to an abrupt change in temperature and the air in the tub is contracted, with the result that negative pressure may be generated in the tub.

In the case in which the temperature of water supplied from the outside is low, therefore, intermittent water supply is performed several times to reduce the temperature of the heated water in the tub 4, thereby preventing negative pressure from being instantaneously generated due to a large amount of water being supplied at once. In this case, N1 times may be 30 times.

In some implementations, the method of controlling the laundry treatment apparatus may include an initial level sensing step (S200) of sensing the initial level of water in the tub before the water supply step (S400).

The initial level sensing step (S200) is performed after the washing course selection step. At the initial level sensing step (S200), whether water is present in the tub 4 is determined before water is supplied into the tub 4.

When the initial level of water sensed at the initial level sensing step (S200) is lower than a predetermined level, the water supply step (S400) may be performed. When the initial level of water sensed at the initial level sensing step (S200) is higher than the predetermined level, intermittent water supply may be repeated N2 times (S500 and S710).

The predetermined level may be a level at which the level of water stored in the tub is sufficient to be heated. Upon determining that the level of water in the tub is higher than the predetermined level, therefore, the heating step (S600), the washing water supply step (S800), and the main washing step (S900) may be performed without performing the water supply step (S400).

Alternatively, upon determining that the level of water in the tub is higher than the predetermined level, a drainage step (not show) of draining water to reduce the level of water in the tub 4 to a level for heating may be performed, followed by the heating step (S600), the washing water supply step (S800), and the main washing step (S900). Consequently, it is possible to make uniform the time for which the heating step is performed through the drainage step of draining water to reduce the level of water in the tub to the level for heating, thereby saving energy. In the case in which intermittent water supply is repeated N2 times, the washing water supply step (S800) and the main washing step (S900) are performed without performing the negative pressure prevention step (S700).

That the sensed initial level of water is higher than the predetermined level means that water has already been stored in the tub 4.

When the temperature sensor 106 cannot directly measure the temperature of water stored in the tub 4, it is not possible to measure the temperate of water stored in the tub 4.

In order to solve this problem, upon determining that water has already been stored in the tub 4, intermittent water supply is performed several times to reduce the temperature of the heated water in the tub 4, thereby preventing negative pressure from being instantaneously generated due to a large amount of water being supplied at once. N2 times may be 30 times.

The laundry treatment apparatus may include a water level sensor 102 for transmitting electromagnetic waves (including ultrasonic waves) to water and receiving the electromagnetic waves reflected by the water.

In one example, in the case in which the level of water in the tub 4 is directly measured, the water level sensor 102 is provided at the upper side of the tub 4 to measure the level of water stored in the tub 4. A water level frequency measured by the water level sensor is in inverse proportion to the level of water in the tub. That is, when the water level frequency is high, the level of water in the tub may be low, and when the water level frequency is low, the level of water in the tub may be high.

In another example, in the case in which the level of water in the tub 4 is indirectly measured, the water level sensor 102 may measure the level of water in a water level pipe 102*a* that is vertically provided so as to be parallel to the tub 4. The water level pipe 102*a* is connected to the lower side of the tub 4. Under atmospheric pressure, the level of water in the tub 4 is equal to the level of water in the water level pipe 102*a*.

At the heating step (S600), the heater 411 installed at the bottom surface of the tub 4 is driven to heat the water stored in the tub 4. In addition, at the heating step (S600), water is supplied to a first level, which is lower than a washing level for main washing. The reason for this is that a large amount of time is required to heat a large amount of water. Consequently, water is supplied into the tub 4 only to a first level at which laundry is sufficiently immersed in the water.

If the washing water supply step (S800) is performed to directly supply water to the washing level after the heating step (S600), water is introduced into the tub 4 to the washing level, which is higher than the first level, within a short time. As a result, the temperature of the water stored in the tub 4 is abruptly lowered, and the heated air in the tub 4 is abruptly condensed (i.e. contracted) due to the low-temperature water.

For this reason, high negative pressure is instantaneously generated in the tub 4. As a result, the door 45 or the tub cover 43 may be deformed, a gap may be formed between the door 45 and the tub cover 43, or force may be applied to the door 45 such that the door is moved toward the inside of the tub, whereby the locking unit of the door may be unlocked and thus the door 45 may open.

Figure 9:
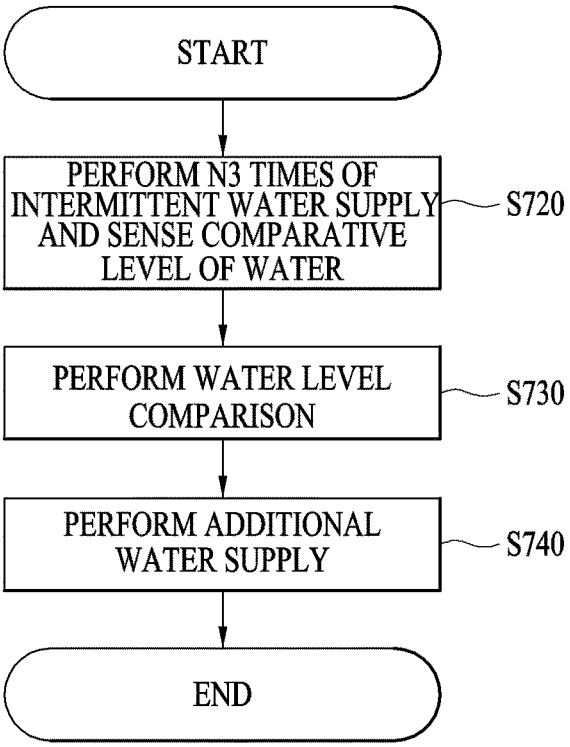
FIG. 9 is a flowchart illustrating an example control method to prevent negative pressure in a tub of a laundry treatment apparatus.

FIG. 9 is a flowchart showing a control method for preventing negative pressure from being generated in the tub.

At the negative pressure prevention step (S700), intermittent water supply is performed to supply water into the tub 4 for a first predetermined amount of time and to interrupt the supply of water for a second predetermined amount of time.

The first predetermined amount of time may be shorter than the second predetermined amount of time. In order words, the second predetermined amount of time may be longer than the first predetermined amount of time. For example, the first predetermined amount of time may be about 0.1 seconds, and the second predetermined amount of time may be about 2 seconds. Consequently, a small amount of water is supplied, and then waiting is performed for a relatively long time such that the heated water in the tub 4 sufficiently exchanges heat with the supplied water to achieve thermal equilibrium.

In particular, the water supply time is shortened to supply a small amount of water into the tub such that the temperature of the heated water is not abruptly changed and such that negative pressure is not abruptly generated in the tub. However, the waiting time for which water is not supplied is long such that the water in the tub 4 sufficiently exchanges heat with the supplied water to achieve thermal equilibrium.

In the intermittent water supply, the controller 101 performs control such that the water supply valve 77 is open for the first predetermined amount of time in order to supply water into the tub 4 through the spray unit 93 and such that the water supply valve 77 is closed for the second predetermined amount of time to obtain the waiting time.

For example, when the intermittent water supply is performed twice, the controller 101 performs control such that the water supply valve 77 is open for the first predetermined amount of time and is closed for the second predetermined amount of time, which is repeated twice.

The negative pressure prevention step (S700) includes a comparative level sensing step (S720) of performing intermittent water supply N3 times and sensing a comparative level of water and a water level comparison step (S730) of comparing the sensed initial level of water with the sensed comparative level of water.

Furthermore, the negative pressure prevention step (S700) may include an additional water supply step (S740) of further performing intermittent water supply N4 times based on the comparison result.

At the comparative level sensing step (S720), the comparative level of water in the tub 4 is sensed within the second predetermined amount of time included in each time period for intermittent water supply. Alternatively, the comparative level of water in the tub 4 is sensed after the second predetermined amount of time included in each time period for intermittent water supply.

The reason that the comparative level of water is measured after intermittent water supply at the comparative level sensing step (S720) is that negative pressure is generated in the tub due to the contraction of air caused by the abrupt change of temperature in the tub 4 only when the intermittent water supply is performed. The greater the difference between the temperature of the supplied water and the temperature of the heated water in the tub, the higher the instantaneous negative pressure that is generated in the tub. Consequently, it is possible to indirectly measure the temperature of water in the tub because it is proportional to the magnitude of the instantaneous negative pressure. When high negative pressure is generated, the level of water in the tub is instantaneously greatly changed.

In brief, the greater the difference between the comparative level of water measured during intermittent water supply and a reference level of water, the higher the negative pressure that is instantaneously generated in the tub, from which it can be seen that the water in the tub has been heated to a high temperature. Consequently, the greater the difference between the comparative level of water and the reference level of water, the more intermittent water supply is performed to reduce the temperature of water stored in the tub such that the magnitude of instantaneous negative pressure generated in the tub when water is subsequently supplied for washing is reduced.

At the comparative level sensing step (S720), N3 times may be 4 to 10 times, preferably 5 times. The reason that intermittent water supply is performed N3 times at the comparative level sensing step (S720) is that, when the comparative level of water is sensed after 1 to 3 times of intermittent water supply, the sensed comparative level of water may not reflect the level of water in the tub when a small amount of water is actually supplied into the tub. Consequently, the intermittent water supply is performed at least 5 times to set the comparative level of water to be used at the water level comparison step (S730).

The highest one of the comparative levels of water sensed N3 times is selected as the comparative level of water sensed at the water level comparison step (S730). In the case in which the level of water in the tub is indirectly measured (i.e. in the case in which the water level frequency of the water level pipe communicating with the sealed tub is measured), the level of water in the tub at which the highest one of the water level frequencies sensed during N3 times of intermittent water supply is sensed is selected as the sensed comparative level of water. The reason for this is that, when the water level frequency is highest, the level of water in the tub is highest.

At the water level comparison step (S730), the sensed comparative level of water is compared with the sensed initial level of water.

When the difference between the comparative level of water and the initial level of water is less than a predetermined value, water is directly supplied to the washing level without additional intermittent water supply, and then main washing is performed. The reason for this is that, upon determining that the difference between the initial level of water and the comparative level of water measured in the case in which negative pressure is generated in the tub 4 through previous N3 times of intermittent water supply is not great, it may be determined that the temperature of the heated water in the tub has been sufficiently lowered.

As a result, it may be determined that high negative pressure will not be generated in the tub 4 even when water is subsequently supplied for main washing. In this case, no additional water supply is performed (i.e. N4=0).

When the difference between the comparative level of water and the initial level of water exceeds the predetermined value, the number of times of additional intermittent water supply is increased. That is, N4 is not fixed but varies depending on the difference. N4 may be preset and stored in the form of a table.

In some implementations, in the case in which the method of controlling the laundry treatment apparatus is temporarily stopped or completely stopped during intermittent water supply, the negative pressure prevention step (S700) is performed again from the beginning. That is, in the case in which the laundry treatment apparatus is temporarily stopped or completely stopped during intermittent water supply, the comparative level sensing step (S720), the water level comparison step (S730), and the additional water supply step (S740) are sequentially performed.

When the laundry treatment apparatus is temporarily stopped or completely stopped, therefore, the case in which the temperature of water stored in the tub is unexpectedly changed, such as the case in which no water is supplied through the water supply unit 7, is provided for, and negative pressure is prevented from being generated in the tub.

When intermittent water supply is performed several times after the interior of the tub is heated and before washing water supply for washing is performed, followed by washing water supply, as shown in FIG. 7B, negative pressure may be instantaneously generated in the tub during the washing water supply. However, the generated negative pressure is not sufficiently high to deform the tub cover or the door or to unlock the push/open button type locking unit of the door. As a result, the door is not opened.

Hereinbefore, the method of controlling the laundry treatment apparatus to prevent instantaneous and abrupt difference in pressure between the inside and the outside of the tub 4 has been described.

Hereinafter, the structural features of the laundry treatment apparatus for preventing instantaneous and abrupt difference in pressure between the inside and the outside of the tub 4 will be described.

The laundry treatment apparatus may include an air channel unit for allowing the inside and the outside of the tub to communicate with each other. When high negative pressure or positive pressure is generated in the tub 4, therefore, air may flow through the air channel unit, whereby it is possible to prevent instantaneous and abrupt difference in pressure between the inside and the outside of the tub 4.

Figure 12:
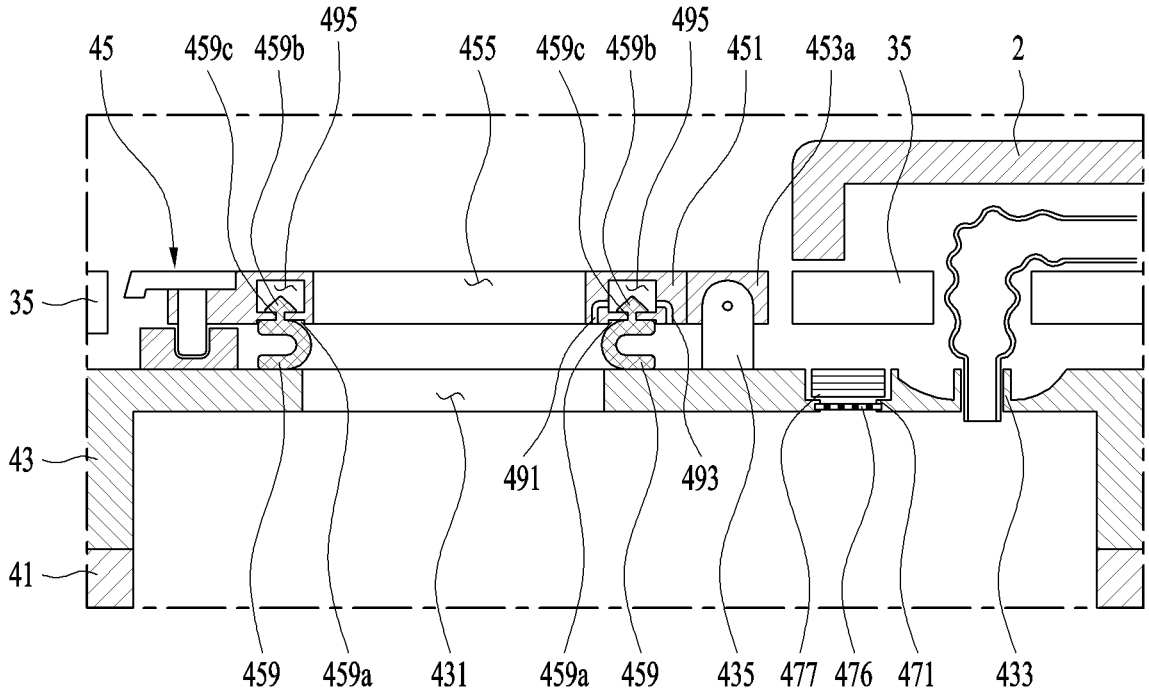
FIG. 12 is a diagram illustrating an example laundry treatment apparatus.
Figure 13:
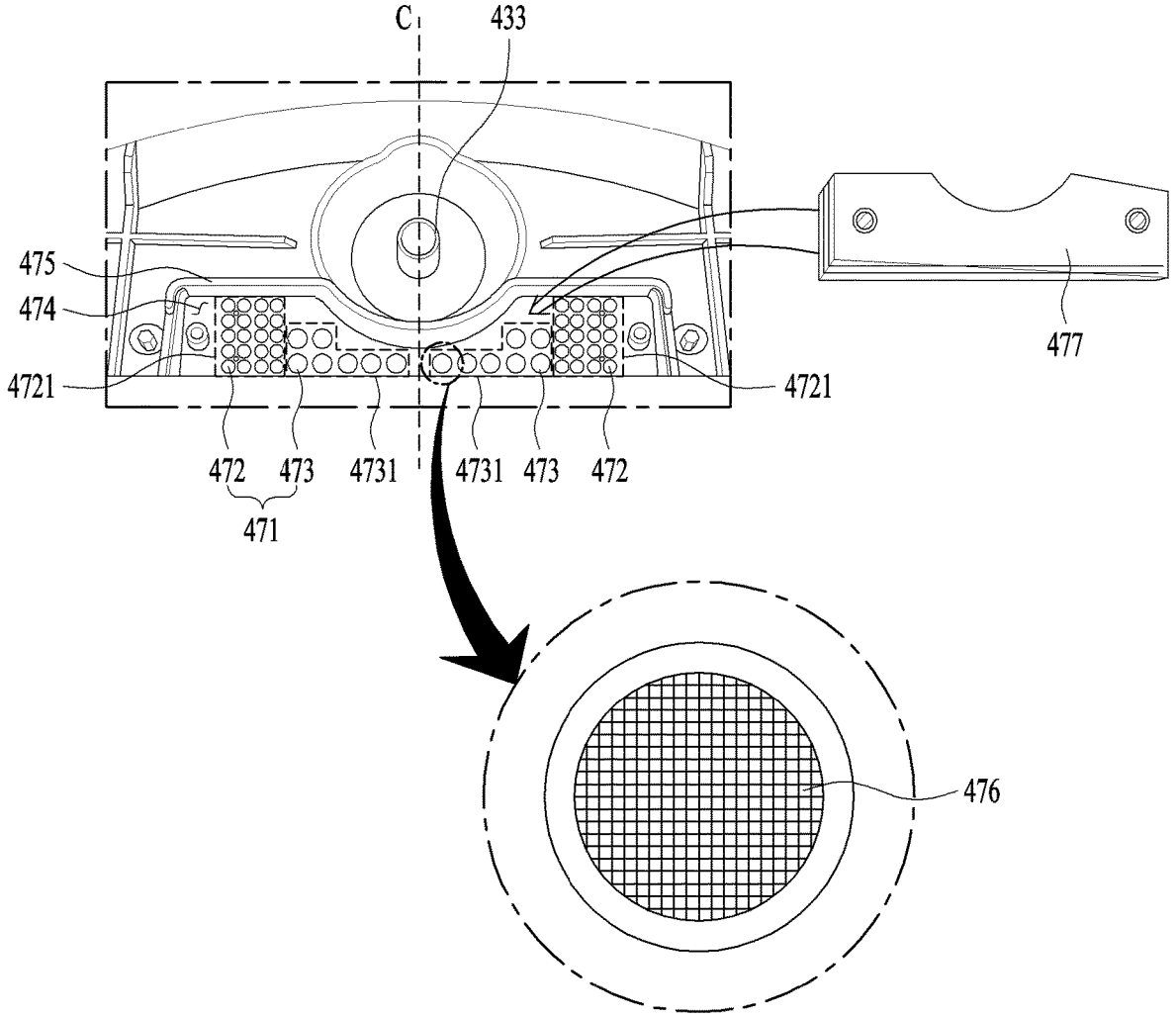
FIG. 13 is a diagram illustrating an example tub air channel unit of a laundry treatment apparatus.

FIG. 11 illustrates an example door of the laundry treatment apparatus in a state in which the example door is open. FIG. 12 illustrates an example laundry treatment apparatus. FIG. 13 illustrates an example tub air channel unit of a laundry treatment apparatus.

The laundry treatment apparatus may include a tub 4, including a tub body 41 for storing water, a tub cover 43 defining the upper surface of the tub body 41, an introduction port 431 formed through the tub cover 43 for allowing laundry to be introduced therethrough, and a support port 433 provided in the tub cover 43 for supplying water to the tub body 41, a drum 5 rotatably provided in the tub, the drum 5 having an open surface communicating with the introduction port 431, a door 45 for opening and closing the introduction port 431, and a tub air channel unit 47 provided in the tub cover 43 for allowing the inside and the outside of the tub 4 to communicate with each other.

The tub body 41 is configured as a cylindrical shape that is open at the upper side thereof, and has a predetermined height. Wash water is stored in the tub body 41. The tub cover 43 covers the upper side of the tub body 41 to define space for storing wash water in the tub 4. Consequently, the inside and the outside of the tub 4 to communicate with each other only through the introduction port 431, which is provided in the tub cover 43.

The introduction port 431 is a port for introducing laundry into the tub body 41 or removing the laundry from the tub body 41. The introduction port 431 is opened and closed by the door 45.

The introduction port 431 may be configured as a polygonal shape, a circular shape, an oval shape, or a half-moon shape. In this example, the introduction port 431 may be configured as a half-moon shape. The reason for this is that, even when the drawer 3 is completely withdrawn from the cabinet 2, as shown in FIG. 1, the upper surface of the tub 4 is not entirely visible. In the case in which the introduction port 431 is provided only in the portion of the upper surface of the tub 4 that is withdrawn from the cabinet 2, the introduction port 431 may be configured as a half-moon shape. In this case, the half-moon shape introduction port 431 includes a straight part 431*a* and a curved part 431*b* connected to the straight part 431*a*.

The introduction port 431 is provided at the front side of the tub cover 43 (i.e. in the positive x-axis direction). The reason for this is that, when the drawer 3 is withdrawn, the introduction port 431 is visible such that laundry can be introduced into or removed from the drum 5.

The sectional area of the introduction port 431 may be greater than half the sectional area of the upper surface of the tub cover 43. In some implementations, the central axis of the tub 4 or the drum 5 may be located in the introduction port 431 such that the laundry received in the drum 5 is easily visible.

The supply port 433 is provided in the portion of the tub cover 43 at which the introduction port 431 is not provided. That is, the supply port 433 is provided in the upper surface of the tub cover 43 at the rear side of the introduction port 431. In the case in which the introduction port 431 is configured as a half-moon shape, the supply port 433 is provided in the tub cover 43 so as to be spaced apart from the straight part 431*a* of the introduction port 431. Even when the drawer 3 is completely withdrawn from the cabinet 2, the supply port 433 is not exposed through the open surface 21 of the cabinet 2, with the result that the supply port 433 is not visible.

In some implementations, the tub air channel unit 47 is configured to allow the inside and the outside of the tub 4 to communicate with each other. When negative pressure is generated in the tub 4, air moves from the outside to the inside of the tub 4 through the tub air channel unit 47. When positive pressure is generated in the tub 4, air moves from the inside to the outside of the tub 4 through the tub air channel unit 47. Consequently, it is possible to prevent the door 45 from being opened or the tub 4 from being deformed due to instantaneous and abrupt difference in pressure between the inside and the outside of the tub 4. In addition, it is possible to prevent noise from being generated between the door 45 and the tub 4.

The tub air channel unit 47 may include an air hole 471 formed through the tub cover 43 such that air can directly flow between the inside and the outside of the tub through the air hole 471.

The tub air channel unit 47 is provided between the introduction port 431 and the supply port 433. In other words, the tub air channel unit 47 may be provided in the central part of the tub cover 43. The water stored in the tub 4 moves upward due to the rotation of the drum 4. The upwardly moving water moves upward along the inner circumferential surface of the tub body 41 and reaches the edge of the tub cover 43. Some of the upwardly moving water reaches the center of the tub cover 43. In order to maximally prevent water from being discharged from the tub 4, therefore, the tub air channel unit 47 may be provided between the introduction port 431 and the supply port 433, i.e. in the central part of the tub cover 43.

In some implementations, the tub air channel unit 47 is provided in the upper surface of the tub cover, which is at the rear side of the introduction port 431. In this case, the tub air channel unit 47 is not exposed to the outside of the cabinet when the drawer is completely withdrawn from the cabinet, with the result that the tub air channel unit 47 is not visible.

The air hole 471 formed through the tub cover 43 may include a first air hole 472 and a second air hole 473 having a larger sectional area than the first air hole 472. In other words, the diameter of the second air hole 473 is greater than that of the first air hole 472.

The second air hole 473 is closer to an imaginary line C interconnecting the centers of the supply port 433 and the introduction port 431 than the first air hole 472. In other words, the second air hole 473, the diameter of which is relatively large, is close to the central part of the tub 4, and the first air hole 473, the diameter of which is relatively small, is distant from the central part of the tub 4. As a result, it is possible to maximally prevent a stream of water moving upward in the tub 4 from being discharged to the outside through the air hole 471.

The air hole 471 may include a first group 4721 constituted by a plurality of first air holes 472 and a second group 4731 constituted by a plurality of second air holes 473. That is, the first group 4721 is a region in which a plurality of first air holes 472 is provided, and the second group 4731 is a region in which a plurality of second air holes 473 is provided.

The second group 4731 is closer to the imaginary line interconnecting the centers of the supply port 433 and the introduction port 431 than the first group 4721, and the first group 4721 is farther from the imaginary line than the second group 4731. In addition, the second group 4731 is closer to the center of the tub 4 than the first group 4721, and the first group 4721 is further from the center of the tub 4 than the second group 4731. Consequently, it is possible to maximally prevent a stream of water moving upward in the tub 4 from being discharged out of the tub.

In order to prevent the water discharged out of the tub 4 through the air hole 471 from flowing to other components provided in the cabinet 2, the tub cover 43 may be provided in the upper surface thereof with a recess 474. In this case, the air hole 471 is provided in the bottom surface of the recess 474. Consequently, the water discharged out of the tub 4 through the air hole 471 is temporarily stored in the recess 474. When the rotation of the drum 5 is stopped, the water stored in the recess 474 flows into the tub 4 through the air hole 471.

Alternatively, in order to prevent the water discharged out of the tub 4 through the air hole 471 from flowing to other components provided in the cabinet 2, the tub cover 43 may be provided on the upper surface thereof with a partition wall 475, which protrudes to define a space part 474 that is open upward. In this case, the air hole 471 is provided in the bottom surface of the space part 474. The partition wall 475 is provided along a plurality of air holes 471 to form a closed loop. Consequently, the water discharged out of the tub 4 through the air holes 471 is temporarily stored in the space part, and then flows into the tub 4 through the air holes 471.

In some implementations, each of the air holes 471 is provided with a net 476. The net 476 is formed by a plurality of lines that intersect, and has a plurality of gaps. The net 476 is provided to block a corresponding one of the air holes 471. The nets 476 maximally prevent wash water or bubbles from flowing through the air holes 471, and allow air to flow through the air holes 471.

The nets 476 are provided in the first air holes 472 and the second air holes 473 to prevent wash water or bubbles from flowing through the first air holes 472 and the second air holes 473. The nets 476 may be made of stainless steel or plastic.

The reason that a plurality of air holes 471 is formed is that, if a single air hole is formed so as to have the same area as a plurality of air holes, the air hole may be closed by water film. Water is cohesive, whereby water film is easily formed. Consequently, a single air hole and a single net may be blocked by water film formed by water and bubbles. As a result, air may not flow between the inside and the outside of the tub 4 due to negative pressure instantaneously and abruptly in the tub 4. In contrast, some of the air holes may be blocked by water film formed by water and bubbles; however, the other air holes are not blocked by the water film, whereby air may flow between the inside and the outside of the tub 4.

In some implementations, the laundry treatment apparatus may further include a filter 477 provided in the recess 474 or the space part 474. The filter 477 absorbs water or bubbles flowing through the air hole 471 to prevent the water or bubbles from being discharged from the upper surface of the tub cover 43 to the outside.

In some implementations, the laundry treatment apparatus may further include a door air channel unit 49 provided in the door 45 for allow the inside and the outside of the tub 4 to communicate with each other.

Consequently, it is possible to prevent instantaneous and abrupt difference in pressure between the inside and the outside of the tub 4.

Figure 14:
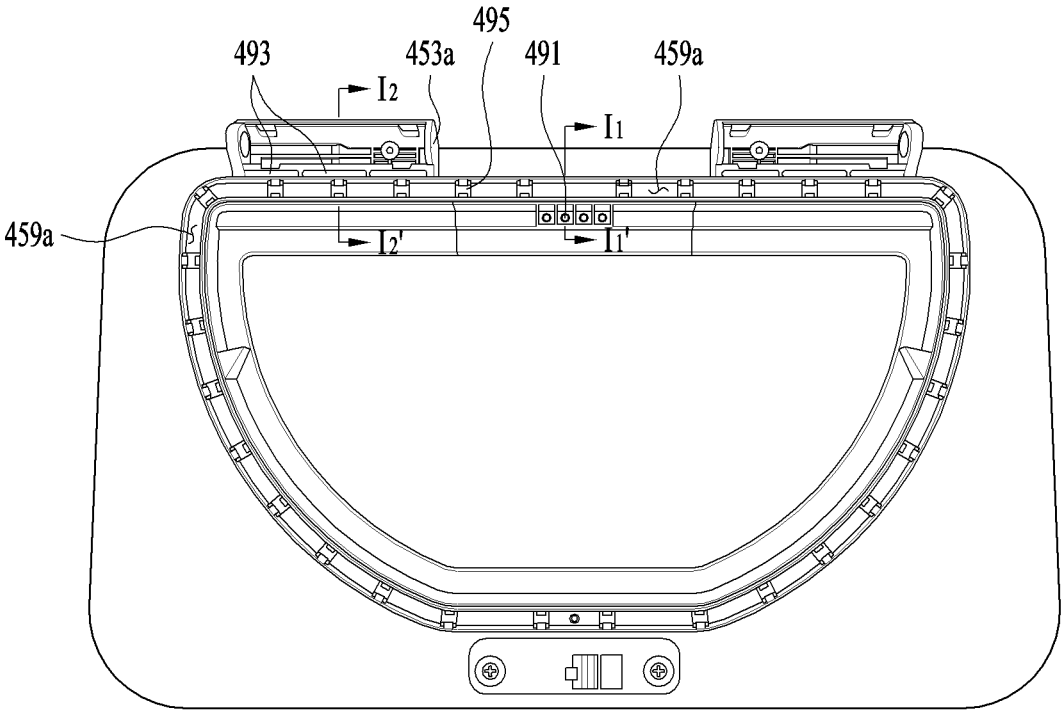
FIG. 14 is a diagram illustrating an example door air channel unit of a laundry treatment apparatus.
Figure 15A:
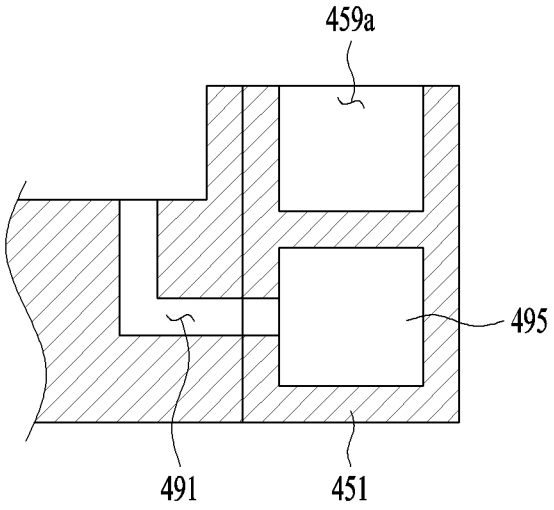
FIGS. 15A and 15B are diagrams illustrating the example door air channel unit of FIG. 14.
Figure 15B:
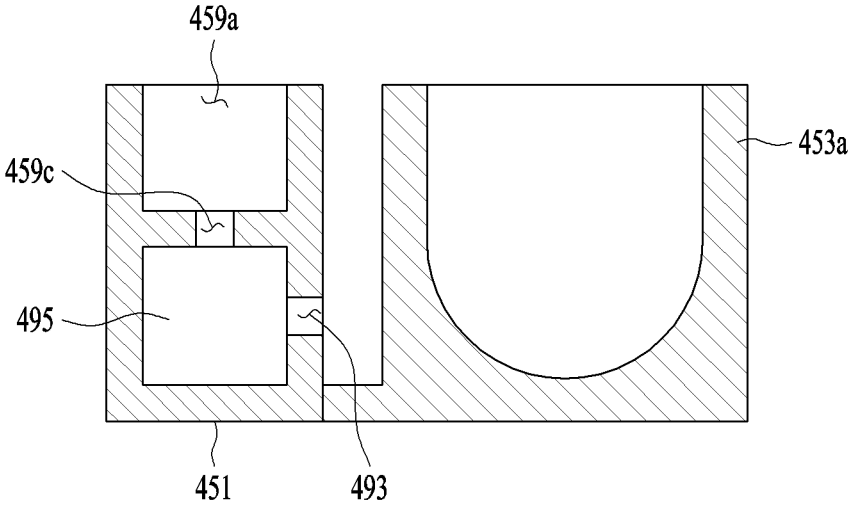

FIG. 14 illustrates an example door air channel unit 49 of a laundry treatment apparatus. FIGS. 15A and 15B illustrate the example door air channel unit 49 of FIG. 14.

The door air channel unit 49 is provided in the door 45, unlike the tub air channel unit 47, which is provided in the tub cover 43.

The door 45 opens and closes the introduction port 431. The door 45 includes a frame 451 hingedly connected to the tub cover 43 and a window 455 provided at the frame 451.

The window 455 is provided in the frame 451 so as to surround the window 455. The shape of the frame 451 may be configured to correspond to that of the introduction port 431 (see FIG. 1), or may be configured to cover the introduction port (see FIG. 14).

The frame 451 includes a hinge socket 453*a*, into which a hinge shaft 435 provided on the upper surface of the tub cover 43 is inserted such that the frame 451 is hingedly connected to the tub cover 43.

The hinge shaft 435 protrudes from the upper surface of the tub cover 43. The hinge socket 453*a* is provided inside thereof with a predetermined space, into which the hinge shaft 435 is inserted. The hinge socket 453*a* is formed at the rear end of the frame 451. Two hinge sockets 453*a* are provided at the rear end of the frame 451 so as to be spaced apart from each other.

The window 455 may be made of a transparent material such that a user can check the interior of the tub body 41 when the drawer 3 is withdrawn from the cabinet 2. The window 455 is provided in a window mounting part formed through the frame 451. The shape of the window 455 may be configured to correspond to that of the introduction port 431. Alternatively, the area of the window 455 may be less than that of the introduction port 431.

In order to prevent the water in the tub body 41 from being discharged out of the tub body 41 through the introduction port 431, one of the frame 451 and the tub cover 43 may be provided with a sealing portion 459 for sealing the space between the frame 451 and the introduction port 431 when the door 45 closes the introduction port 431.

The sealing portion 459 is made of rubber. When the door 45 is fastened to the introduction port 431 via the hook, the sealing portion 459 seals the gap between the door 45 and the tub cover 43 while pressing the lower surface of the door 45 and the upper surface of the tub cover 43. The shape of the sealing portion 459 may be configured to correspond to that of the introduction port 431.

The sealing portion 459 may be mounted to a sealing portion fixing part 459*a* provided at the frame 451. The sealing portion fixing part 459*a* may be concavely provided in the lower surface of the frame 451 so as to have a predetermined depth. Alternatively, the sealing portion fixing part 459*a* may include two fixing part partition walls 475 protruding from the lower surface of the frame 451 to a predetermined height. The fixing part partition walls 475 are spaced apart from each other. Each of the fixing part partition walls 475 is formed so as to have a closed loop. The sealing portion 459 is mounted between the fixing part partition walls 475.

The sealing portion fixing part 459*a* may be provided around the window 455. The shape of the sealing portion fixing part 459*a* may be configured to correspond to that of the introduction port 431.

The sealing portion 459 includes an attachment and detachment protrusion 459*b* protruding toward the door 45 such that the sealing portion 459 is easily attached to and detached from the door 45. The door 45 includes a sealing portion insertion part 459*c*, into which the attachment and detachment protrusion 459*b* is inserted so as to be fixed to the door 45. The sealing portion insertion part 459*c* is provided inside the sealing portion fixing part 459*a*.

In some implementations, the door air channel unit 49 may be formed through the door 45 or the frame 451 to allow the inside and the outside of the tub 4 to communicate with each other.

Steam or hot water generated in the tub 4 may be discharged through the door air channel unit 49. In order to prevent injury, therefore, the door air channel unit 49 may be located at the vicinity of the shaft of the frame 451. In other words, the door air channel unit 49 may be provided at the rear end of the frame 451 or between the frame 451 and the hinge socket 453*a*.

The door air channel unit 49 may extend from the upper surface to the lower surface of the door 45 or the frame 451. If steam or hot water generated in the tub 4 is discharged through the upper surface of the door 45 or the frame 451, however, a safety-related accident may occur.

In order to solve the above problem, the end of the door air channel unit 49, which allows the inside and the outside of the tub 4 to communicate with each other, may be provided in the lower surface of the door 45 or the frame 451.

In particular, the door air channel unit 49 may include a hollow portion 495 provided in the door 45, a first air channel 491 for allowing the inside of the tub and the hollow portion 495 to communicate with each other, and a second air channel 493 for allowing the outside of the tub 4 and the hollow portion 495 to communicate with each other.

In this case, the end of the first air channel 491 and the end of the second air channel 493 communicate with the lower side (i.e. the lower surface) of the door 45 such that steam or hot water discharged from the tub 4 is not directly transmitted to a user.

The end of the first air channel 491 communicates with the inside of the tub 4. Consequently, the end of the first air channel 491 may be provided adjacent to the center of the tub 4 in order to maximally prevent water or bubbles from being introduced into the first air channel 491. The end of the second air channel 493 communicates with the outside of the tub 4. Consequently, the end of the second air channel 493 may be provided farther from the center of the tub 4 than the end of the first air channel 491.

The end of the first air channel 491 is provided outside the sealing portion fixing part 459*a*, and the end of the second air channel 493 is provided inside the sealing portion fixing part 459*a*.

The end of the first air channel 491 may be provided at the center of the door 45 or the frame 451 in the leftward-rightward direction (i.e. the Y-axis direction or the lateral direction), and the end of the second air channel 493 may be provided between the frame 451 and the hinge socket 453*a*. In this case, the hollow portion 495, which communicates with the first air channel 491 and the second air channel 493, is provided in the frame 451 in the leftward-rightward direction.

The hollow portion 495 may be provided above the sealing portion fixing part 459*a*. The hollow portion 495 and the sealing portion fixing part 459*a* may communicate with each other through the sealing portion insertion part 459*c*. The attachment and detachment protrusion 459*b* of the sealing portion 459 may be inserted and fastened into the hollow portion 495 through the sealing portion insertion part 459*c*.

This example can prevent instantaneous and abrupt difference in pressure between the inside and the outside of the tub 4 owing to the above structural features thereof.

In addition, this example can prevent noise from being generated by air flowing through the gap between the door 45 and the tub cover 43 when the door 45 is opened or closed.

Furthermore, this example can prevent the water level sensor 102 from incorrectly measuring the level of water, which may occur due to the instantaneous difference in pressure between the inside and the outside of the tub 4.

As previously described, the laundry treatment apparatus may be an auxiliary laundry treatment apparatus that is coupled to a main laundry treatment apparatus. For example, a general washing apparatus may be referred to as a first washing apparatus, and a washing apparatus may be referred to as a second washing apparatus. In this case, the first washing apparatus and the second washing apparatus may constitute a single laundry treatment apparatus. The first washing apparatus and the second washing apparatus may be separately manufactured so as to be capable of being coupled to each other. The second washing apparatus may be disposed on or under the first washing apparatus.

Hereinafter, a laundry treatment apparatus including a first washing apparatus and a second washing apparatus provided in a single cabinet will be described. The basic features of the second washing apparatus may be identical to those of the previous example. That is, since the height and volume of the second washing apparatus are smaller than those of the first washing apparatus, the possibility of bubble generation is high, and it is critical to prevent the generation of bubbles.

Figure 16:
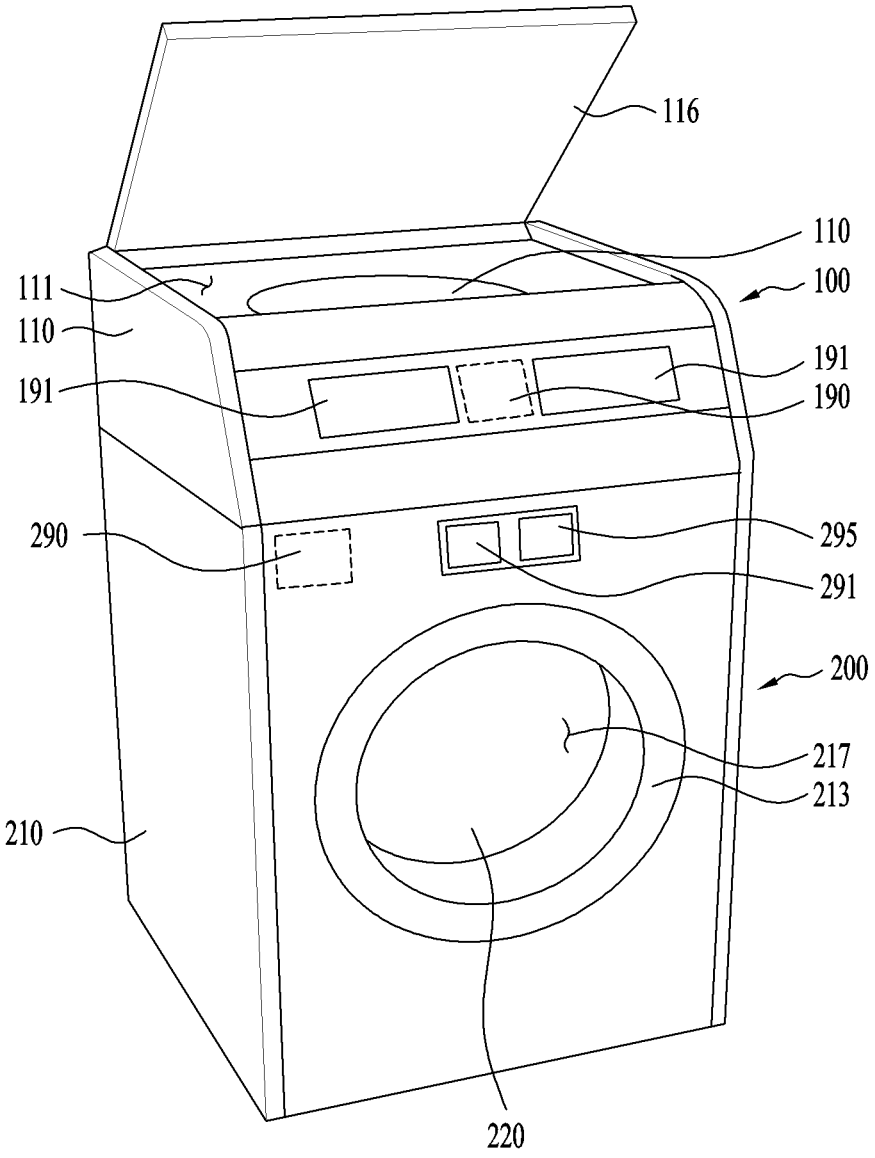
FIG. 16 is a diagram illustrating an example laundry treatment apparatus.
Figure 17:
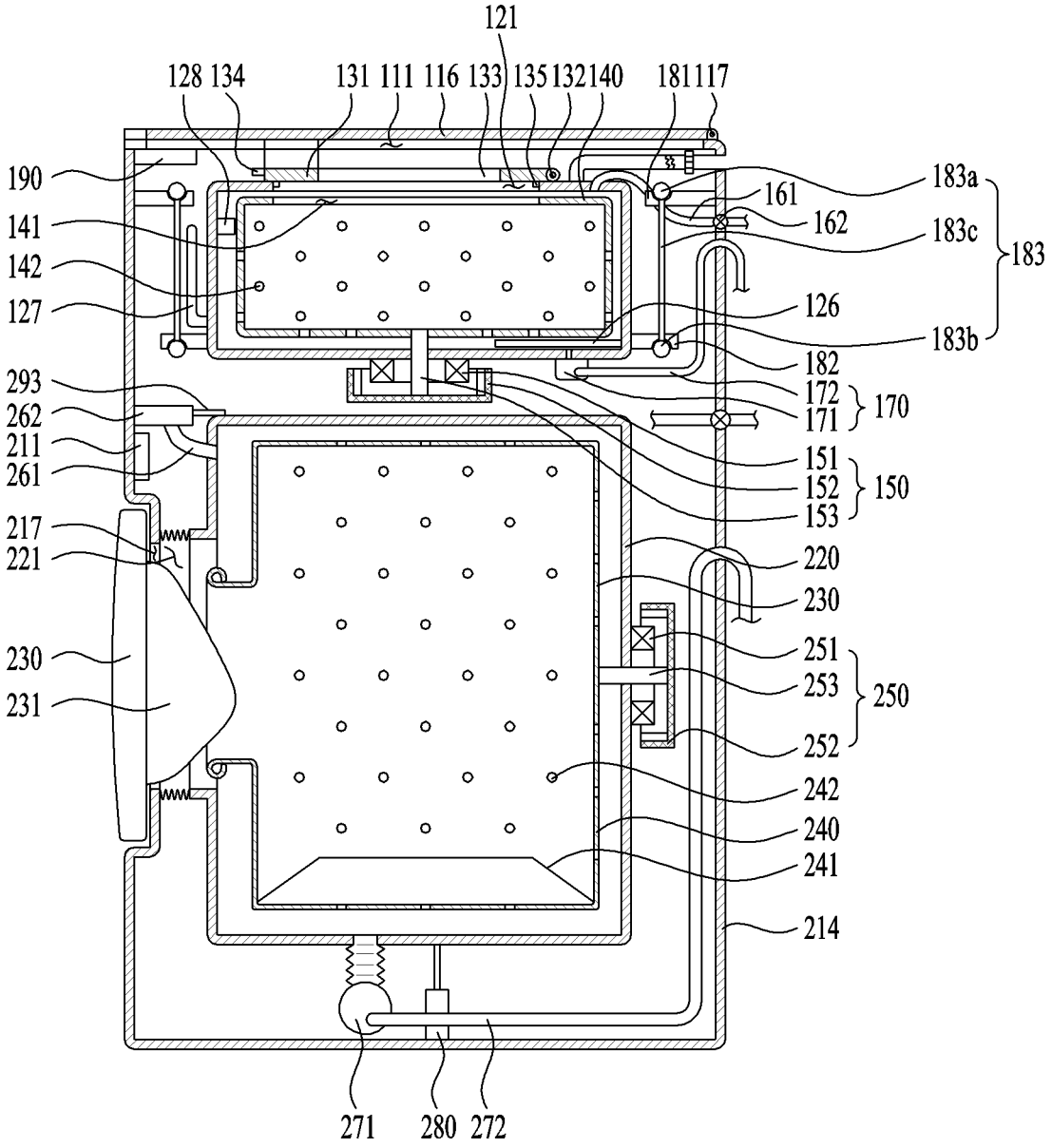
FIG. 17 is a diagram illustrating an example the example laundry treatment apparatus of FIG. 16.

FIG. 16 illustrates an example laundry treatment apparatus. FIG. 17 illustrates an example the example laundry treatment apparatus of FIG. 16.

As shown in FIGS. 16 and 17, a laundry treatment apparatus includes a front loading type laundry treatment apparatus 200 and a top loading type laundry treatment apparatus 100 disposed on the front loading type laundry treatment apparatus.

The top loading type laundry treatment apparatus 100 may be integrally coupled to the front loading type laundry treatment apparatus 200.

The front loading type laundry treatment apparatus is a laundry treatment apparatus configured such that an opening is provided in the front of the laundry treatment apparatus and such that the shaft of a drum is parallel to the ground or inclined from the ground by a predetermined angle, and the top loading type laundry treatment apparatus is a laundry treatment apparatus configured such that an opening is provided in the top of the laundry treatment apparatus and such that the shaft of a drum is perpendicular to the ground.

The front loading type laundry treatment apparatus 200 may be defined as a first laundry treatment apparatus, and the top loading type laundry treatment apparatus 100 may be defined as a second laundry treatment apparatus.

The laundry treatment apparatus may be configured such that the front loading type laundry treatment apparatus 200 and the top loading type laundry treatment apparatus 100 are separately provided, such that the front loading type laundry treatment apparatus 200 and the top loading type laundry treatment apparatus 100 are coupled to each other, or such that the front loading type laundry treatment apparatus 200 and the top loading type laundry treatment apparatus 100 are integrated.

The laundry treatment apparatus may include a first cabinet 210 having a first opening 217 formed in the front thereof, a first laundry receiving unit 220 and 240 provided in the first cabinet 210 for receiving laundry, a second cabinet 110 provided on the first cabinet 210, the second cabinet 110 having a second opening 111 formed in the top thereof, and a second laundry receiving unit 120 and 140 provided in the second cabinet 110 for receiving laundry. The second laundry receiving unit 120 and 140 may be a drum, which may be rotatably provided in a tub 4.

The first cabinet 210 may define the external appearance of the first laundry treatment apparatus 200, and the second cabinet 110 may define the external appearance of the second laundry treatment apparatus 100.

In addition, the first cabinet 210 and the second cabinet 110 may be coupled to each other to define the entire external appearance of the laundry treatment apparatus.

The first cabinet 210 may be provided at the front thereof with a first display unit 295 for displaying the state of the first laundry treatment apparatus 200, a first input unit 291 for allowing an operation command of the first laundry treatment apparatus 200 to be input, and a first controller 290 for controlling the operation of the first laundry treatment apparatus 200.

In addition, the second cabinet 110 may be provided at the top thereof with a second display unit 195 for displaying the state of the second laundry treatment apparatus 100, a second input unit 191 for allowing an operation command of the second laundry treatment apparatus 100 to be input, and a second controller 190 for controlling the operation of the second laundry treatment apparatus 100.

In the case in which the second laundry treatment apparatus 100 is coupled to the upper part of the first laundry treatment apparatus 200 or in the case in which the first laundry treatment apparatus 200 and the second laundry treatment apparatus 100 are integrated, one selected from between the first controller 290 and the second controller 190 may control both the first laundry treatment apparatus and the second laundry treatment apparatus.

In addition, operation commands may be input to both the first laundry treatment apparatus and the second laundry treatment apparatus through the first input unit 291, or operation commands may be input to both the first laundry treatment apparatus and the second laundry treatment apparatus through the second input unit 191.

Each of the first display unit 295 and the second display unit 195 may include a panel, such as an LCD panel or an LED panel. In addition, each of the first display unit 295 and the second display unit 195 may include a speaker for outputting a sound to provide a user with information.

That is, the first display unit 295 and the second display unit 195 may display information about the laundry treatment apparatuses, and an alarm may be output to provide the user with information.

In some implementations, the first laundry treatment apparatus 200 may be configured as a washing apparatus for washing laundry using detergent and water or as a drying apparatus for drying laundry using hot air.

In the case in which the first laundry treatment apparatus 200 is configured as a washing apparatus, the first laundry receiving unit 220 and 240 may include a first tub 220 having a first introduction port 221 that communicates with the first opening 217 and providing space for storing water and a first drum 240 rotatably provided in the first tub 220 for receiving laundry.

In the case in which the first laundry treatment apparatus 200 is configured as a drying apparatus, the first laundry receiving unit 220 and 240 may include a first drum 240 rotatably provided in the first cabinet 210 for receiving laundry.

FIGS. 16 and 17 show the case in which the first laundry treatment apparatus 200 is configured as a washing apparatus. However, the case in which the first laundry treatment apparatus 200 is configured as a drying apparatus is not excluded.

In addition, the second laundry treatment apparatus 100 may be configured as a washing apparatus for washing laundry using detergent and water or as a drying apparatus for drying laundry using hot air.

In the case in which the second laundry treatment apparatus 100 is configured as a washing apparatus, the second laundry receiving unit 120 and 140 may include a second tub 120, having a second introduction port 121 that communicates with the second opening 111 and providing space for storing water, and a second drum 140, rotatably provided in the second tub 120 for receiving laundry.

A water level sensor 127 for sensing the level of water in the second tub 120 may be provided at one side of the second tub 120, and a temperature sensor 128 for sensing the temperature of the second tub 120 may be provided at the inner circumferential surface of the second tub 120.

In the case in which the second laundry treatment apparatus 100 is configured as a drying apparatus, the second laundry receiving unit 120 and 140 may include a second drum 140 rotatably provided in the second cabinet 110 for receiving laundry.

FIGS. 16 and 17 show the case in which the second laundry treatment apparatus 100 is configured as a washing apparatus. However, the case in which the second laundry treatment apparatus 100 is configured as a drying apparatus is not excluded.

The first laundry treatment apparatus 200 may include a first door 230 for opening and closing the first opening 210. The first door 230 may include a door gasket 231 for sealing the first introduction port 221 formed in the first tub 220 when the first opening 210 is closed.

In some implementations, the first laundry treatment apparatus 200 may include a first water supply unit 260 for supplying water to the first tub 220 and a first drainage unit 270 for draining water from the first tub 220.

The first water supply unit 260 may include a first water supply pipe 261 for supplying water from an external water supply source to the first tub 220, a detergent box 220 for mixing detergent with the water supplied to the first water supply pipe 261 and supplying the mixture to the first tub 220, and a first supply pipe 263 connecting the detergent box 220 to the first tub 220 for supplying the water and the detergent to the first tub 220.

The first drainage unit 270 may include a first drainage pipe 272 provided under the first tub 220 for draining water from the first tub 220 and a first drainage pump 271 for draining water in the first drainage pipe 272 out of the first cabinet 210.

In some implementations, the first laundry treatment apparatus 200 may include a supporting and damping unit 280 for supporting the first tub 220 in the first cabinet 210 and damping vibration generated from the first tub 220 such that the vibration is not transmitted to the first cabinet 210.

The supporting and damping unit 280 may be configured as a damper, a spring, or a combination thereof. A plurality of supporting and damping units may be provided.

A supporting and damping unit 280 may be provided at the upper part or the lower part of the first tub 220, or supporting and damping units 280 may be provided at the upper part and the lower part of the first tub 220.

In some implementations, the first laundry treatment apparatus 200 may include a first driving unit 250 for rotating the first drum 230.

The first driving unit 250 may include a first stator 251 provided at the rear surface of the first tub 220 for generating a rotating magnetic field, a first rotor 252 configured to be rotated by the rotating magnetic field generated by the first stator 251, and a shaft 253 having one end connected to the first rotor 252 and the other end extending through the first tub 220 so as to be connected to the first drum 240.

The shaft 252 may be configured to be parallel to the ground or to be inclined upward from the ground.

The first drum 240 may include a lifter 241 for lifting and dropping laundry when the first drum 240 is rotated to improve washing performance. In addition, the first drum 240 may be provided in the inner circumferential surface thereof with a plurality of through holes 242 through which water is introduced or discharged.

In some implementations, the height of the second laundry treatment apparatus 100 is limited, since the second laundry treatment apparatus 100 is disposed on the first laundry treatment apparatus 200. That is, if the second laundry treatment apparatus 100 is higher, the washing capacity of the second laundry treatment apparatus 100 is further increased; however, it is difficult for a user to access the second opening 111.

As a result, the second tub 120 is relatively low, with the result that water or laundry received in the second tub 120 may be discharged out of the second tub 120.

For this reason, the second tub 120 may include a tub door 130 for opening and closing the second introduction port 121. The tub door 120 closes the second introduction port 121 to prevent water or laundry received in the second tub 120 from being discharged out of the second tub 120.

The tub door 130 may be hingedly provided at the top of the second tub 120.

The tub door 130 may include a frame 131 hingedly coupled to the second tub via a door hinge 132, a window 133 provided in the frame, and a door handle 134 for separably coupling the frame 131 to the second tub 120.

The window 133 may be made of a transparent material such that a user can check the interior of the second tub 120.

In some implementations, in order to prevent the water in the second tub 120 from being discharged out of the second tub 120 through the second introduction port 121, a sealing part 135 for sealing the space between the frame 131 and the second introduction port 121 when the tub door 130 closes the second introduction port 121 may be provided at one selected from between the frame 131 and the inner circumferential surface of the second introduction port 121.

The second laundry treatment apparatus 100 may include a second water supply unit 160 for supplying water to the second tub 120 and a second drainage unit 170 for draining water from the second tub 120.

The second water supply unit 160 may include a second water supply pipe 161 for supplying water from an external water supply source to the second tub 120 and a water supply valve 162 for adjusting the flow rate in the second water supply pipe 161.

The second drainage unit 170 may include a second drainage pipe 172 provided under the second tub 120 for draining water from the second tub 120 and a second drainage pump 171 communicating with the second drainage pipe 172 for draining water in the second drainage pipe 172 out of the second cabinet 110.

The second water supply unit 160 and the second drainage unit 170 may be provided separately from the first water supply unit 260 and the first drainage unit 270, respectively.

The second water supply unit 160 and the second drainage unit 170 may be integrally formed with the first water supply unit 260 and the first drainage unit 270, respectively, or may diverge from the first water supply unit 260 and the first drainage unit 270, respectively.

The reasons for this are that the second laundry treatment apparatus 100 may be separably coupled to the first laundry treatment apparatus 200 or the second laundry treatment apparatus 100 and that the first laundry treatment apparatus 200 may be independently provided.

The top of the second cabinet 110 may be defined by a cover door 116. The cover door 116 may be hingedly provided at one side of the second cabinet 110. The cover door 116 may be hingedly coupled to the second cabinet 110 via a cover hinge 117. The cover hinge 117 may be provided at one side of the cover door 116.

The second drum 140 may include a drum introduction port 141 communicating with the second introduction port 111. In addition, the second drum 140 may be provided in the inner circumferential surface thereof with a plurality of through holes 142, through which water is introduced from or discharged to the second tub 120.

In some implementations, the second laundry treatment apparatus 100 may include a second driving unit 150 for rotating the second drum 140 in the second tub 120.

The second driving unit 150 may include a second stator 151 fixed to the lower surface of the second tub 120 for generating a rotating magnetic field, a second rotor 152 configured to be rotated by the rotating magnetic field generated by the second stator 151, and a shaft 153 having one end connected to the second rotor 152 and the other end extending through the second tub 120 so as to be connected to the second drum 140.

In some implementations, although not shown, the second laundry treatment apparatus 100 may include a heater 126 for heating the water stored in the second tub 120.

In addition, the second laundry treatment apparatus 100 may include a temperature sensor 128 for measuring the temperature of the second tub 120 and a water level sensor 127 for sensing the level of water in the second tub 120.

In some implementations, the second laundry treatment apparatus 100 may include a cover door 116 for opening and closing the second opening 111.

The reason for this is that, if the second water supply unit 160, the second drainage unit 170, and the second driving unit 150, which are provided in the second cabinet 110 and the second tub 120, are exposed to the outside, the aesthetic appearance of the second laundry treatment apparatus is deteriorated and a safety-related accident may occur.

In some implementations, the second laundry treatment apparatus 100 may include a support unit 180 for supporting the second tub 120 in the second cabinet 110.

The support unit 180 may include a first support part 181 provided at the second cabinet 110, a second support part 182 provided at the second tub 120, and a connection part 183 for connecting the first support part 181 and the second support part 182 to each other.

The first support part 181 is provided higher than the second support part 182. One end of the connection part 183 is coupled and fixed to the first support part 181, and the other end of the connection part 183 supports the second support part 182 such that the second tub 120 is fixed in the second cabinet 110.

The first support part 181 may be configured as a first bracket protruding from the second cabinet 110. The second support part 182 may be configured as a second bracket protruding from the second tub 120. The connection part 183 may connect the first bracket and the second bracket to each other. The connection part 183 may be configured to be perpendicular to the ground.

Consequently, the volume of the support unit 180, including the connection part 183, may be minimized, whereby the washing capacity of the second tub 120 may be further increased.

The connection part 183 may include a first connection part 183*a* extending through the first support part 281 so as to be located in the first support part 281, a second connection part 183*b* extending through the second support part 182 so as to support the second support part 182, and a connection bar 183*c* for connecting the first connection part 183*a* and the second connection part 183*b* to each other.

The diameter of the first connection part 183*a* and the second connection part 183*b* may be greater than that of the connection part 183*c*. The first connection part 183*a* and the second connection part 183*b* may be formed in the shape of a disc, a hemisphere, or a sphere. Consequently, the connection part 183 may be stably coupled to the first support part 181 and to the second support part 182.

The examples described above not limited, and various modifications and variations can be made to the examples.

What is claimed is:

1. A laundry treatment apparatus comprising:

a first cabinet door that is configured to open or close a first opening;

a second cabinet door that is configured to open or close a second opening;

a first washing unit that is configured to treat laundry introduced into an interior area of the first washing unit through the first cabinet door in a first direction; and a second washing unit that is configured to treat laundry introduced into an interior area of the second washing unit through the second cabinet door in a second direction, the second washing unit including:

a tub that includes a tub opening at a top of the tub, a tub cover that is coupled to the tub and that covers the tub opening, the tub cover including an introduction port through which laundry is introduced, and a tub door that is coupled to the tub cover and that is configured to open or close the introduction port; and a drum that is located in the tub and that is configured to rotate about a shaft, the shaft extending in the second direction, wherein the tub cover includes an air channel unit that is configured to communicate air between an interior area of the tub and an exterior area of the tub in a state in which the second washing unit is operational, and wherein the air channel unit is configured to, based on the tub door being in a closed state, transfer air between the interior area of the tub and the exterior area of the tub.

2. The laundry treatment apparatus of claim 1, wherein the tub cover includes a tub cover body that is coupled to the tub, and wherein the introduction port is defined at the tub cover body, and the tub door is coupled to the tub cover body.

3. The laundry treatment apparatus of claim 2, wherein the air channel unit includes:

at least one air hole located in the tub cover body.

4. The laundry treatment apparatus of claim 3, wherein the tub cover includes:

a water supply port through which water is supplied into the interior area of the tub from an external water supply source, and wherein the introduction port is located at a first side of the tub cover and the water supply port and the air hole are located at a second side of the tub cover.

5. The laundry treatment apparatus of claim 4, wherein the air hole is located between the introduction port and the water supply port.

6. The laundry treatment apparatus of claim 5, wherein the air hole includes:

a first air hole that has a first sectional area, and a second air hole that has a second sectional area that is larger than the first sectional area.

7. The laundry treatment apparatus of claim 3, wherein the tub cover body includes a recess that is recessed from an upper surface of the tub cover body and that is configured to hold water discharged from the tub, and wherein the air hole includes a plurality of air holes that are located on a bottom surface of the recess.

8. The laundry treatment apparatus of claim 7, wherein each of the plurality of air holes includes a mesh.

9. The laundry treatment apparatus of claim 2, further comprising:

a filter that is coupled to the recess.

10. The laundry treatment apparatus of claim 2, wherein the tub door includes the air channel unit.

11. The laundry treatment apparatus of claim 10, wherein the air channel unit includes:

a hollow portion that is located at the tub door;

a first air channel that is configured to transfer air between the interior area of the tub and the hollow portion; and a second air channel that is configured to transfer air between the exterior area of the tub and the hollow portion.

12. The laundry treatment apparatus of claim 11, further comprising:

a sealing portion that is configured to seal a space between the introduction port and the tub door; and a sealing portion fixing part to which the sealing portion is coupled and that is located adjacent to the hollow portion.

13. The laundry treatment apparatus of claim 12, wherein the sealing portion includes a closed loop, and wherein the air channel unit extends between an inner area of the closed loop and an outer area of the closed loop.

14. The laundry treatment apparatus of claim 2, wherein the tub door includes:

a frame that is configured to rotate and that is coupled to the tub cover body;

a transparent window that is coupled to the frame; and a sealing portion that is coupled to an inner surface of the tub door and that is configured to seal the introduction port.

15. The laundry treatment apparatus of claim 14, wherein the tub door further includes:

a washing guide that is configured to guide water in the tub into a central area of the tub from an edge area of the tub in a state in which the drum is rotated.

16. The laundry treatment apparatus of claim 15, wherein the air channel unit includes:

at least one air hole located in the tub cover body.

17. The laundry treatment apparatus of claim 16, wherein the air hole includes:

a first air hole that has a first sectional area; and a second air hole that has a second sectional area, and wherein the second sectional area is larger than the first sectional area.

18. The laundry treatment apparatus of claim 17, wherein the tub cover body includes a recess that is recessed from an upper surface of the tub cover body and that is configured to hold water discharged from the tub, and wherein the air hole includes a plurality of air holes that are located on a bottom surface of the recess.

19. The laundry treatment apparatus of claim 18, further comprising:

a filter that is coupled to the recess, through which air introduced from the air holes passes, and that is configured to absorb water and bubbles introduced from the air holes.

20. The laundry treatment apparatus of claim 1, wherein the air channel unit is configured to, based on a change of a temperature of water in the tub, communicate air to balance air pressure between the interior area of the tub and the exterior area of the tub.

* * * * *